US011383951B2

(12) United States Patent
Kawakami

(10) Patent No.: US 11,383,951 B2
(45) Date of Patent: Jul. 12, 2022

(54) SHEET PROCESSING APPARATUS, AND IMAGE FORMING SYSTEM

(71) Applicant: CANON FINETECH NISCA INC., Misato (JP)

(72) Inventor: Masato Kawakami, Moriya (JP)

(73) Assignee: Canon Finetech Nisca Inc., Saitama (JP)

( * ) Notice: Subject to any disclaimer, the term of this patent is extended or adjusted under 35 U.S.C. 154(b) by 0 days.

(21) Appl. No.: 16/840,541

(22) Filed: Apr. 6, 2020

(65) Prior Publication Data

US 2020/0317462 A1 Oct. 8, 2020

(30) Foreign Application Priority Data

Apr. 8, 2019 (JP) ..... JP2019-073708
Mar. 27, 2020 (JP) ..... JP2020-058247

(51) Int. Cl.
*B65H 37/04* (2006.01)
*B41J 11/58* (2006.01)

(52) U.S. Cl.
CPC ..... *B65H 37/04* (2013.01); *B41J 11/58* (2013.01)

(58) Field of Classification Search
None
See application file for complete search history.

(56) References Cited

U.S. PATENT DOCUMENTS

| | | | | |
|---|---|---|---|---|
| 9,399,841 | B2 * | 7/2016 | Yamada | D21H 17/70 |
| 9,914,280 | B2 * | 3/2018 | Takashima | B31F 5/022 |
| 10,344,478 | B2 * | 7/2019 | Foster | B28B 23/0006 |
| 10,406,772 | B2 * | 9/2019 | Takahashi | B42C 19/02 |
| 10,654,240 | B2 * | 5/2020 | Takahashi | B42B 5/00 |
| 10,759,135 | B2 * | 9/2020 | Takahashi | B65H 37/04 |
| 2018/0339484 | A1 * | 11/2018 | Takahashi | G03G 15/6544 |
| 2018/0339485 | A1 * | 11/2018 | Takahashi | B42C 1/12 |
| 2019/0351638 | A1 * | 11/2019 | Takahashi | B42C 1/12 |
| 2020/0275809 | A1 * | 9/2020 | Paveletzke | B32B 27/08 |

FOREIGN PATENT DOCUMENTS

| | | | |
|---|---|---|---|
| JP | 3481300 | B2 | 12/2003 |
| JP | 3502204 | B2 | 3/2004 |
| JP | 2014-201432 | A | 10/2014 |
| JP | 2018-199553 | A | 12/2018 |

* cited by examiner

*Primary Examiner* — Leslie A Nicholson, III
(74) *Attorney, Agent, or Firm* — Venable LLP

(57) ABSTRACT

A sheet processing apparatus for performing binding processing for a sheet bundle formed from a plurality of sheets, comprises: an application unit configured to apply a liquid to a sheet wherein the application unit applies the liquid to an outermost sheet of the sheet bundle, and a static surface tension of the liquid is lower than a static surface tension of water; and a binding processing unit configured to bind the sheet bundle, without using a staple, wherein the binding processing unit includes a pair of groups of pressurizing teeth, and the pressurizing teeth clamp and pressurize the sheet bundle. In the sheet bundle, a liquid application region which is applied with the liquid and a pressurizing region which is pressurized by the pressurizing teeth are provided to overlap each other.

7 Claims, 19 Drawing Sheets

FIG. 4A
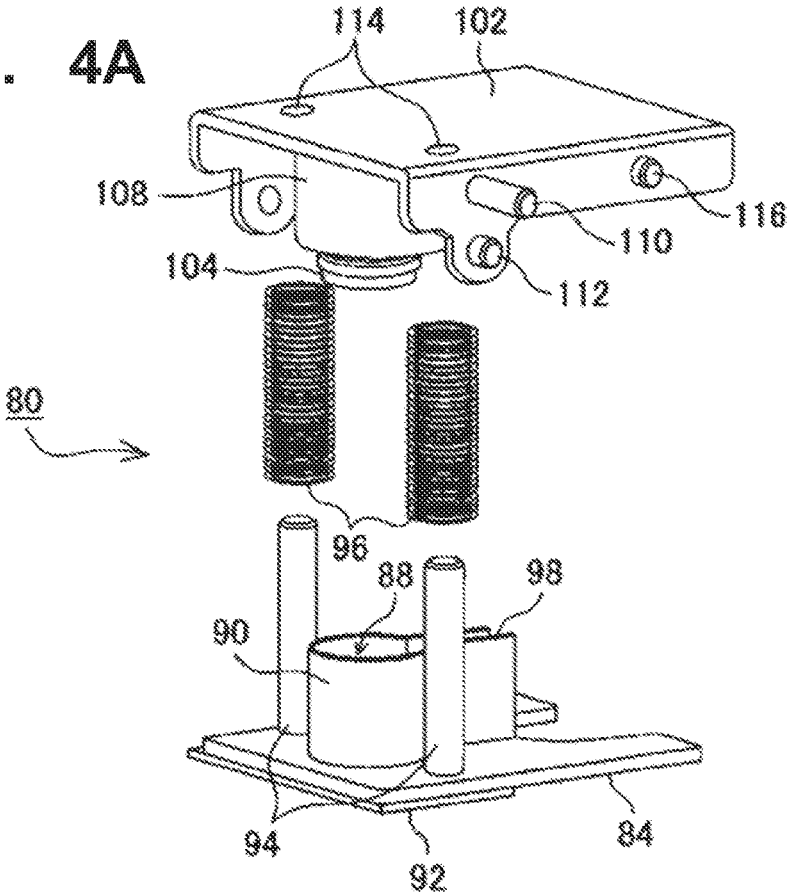
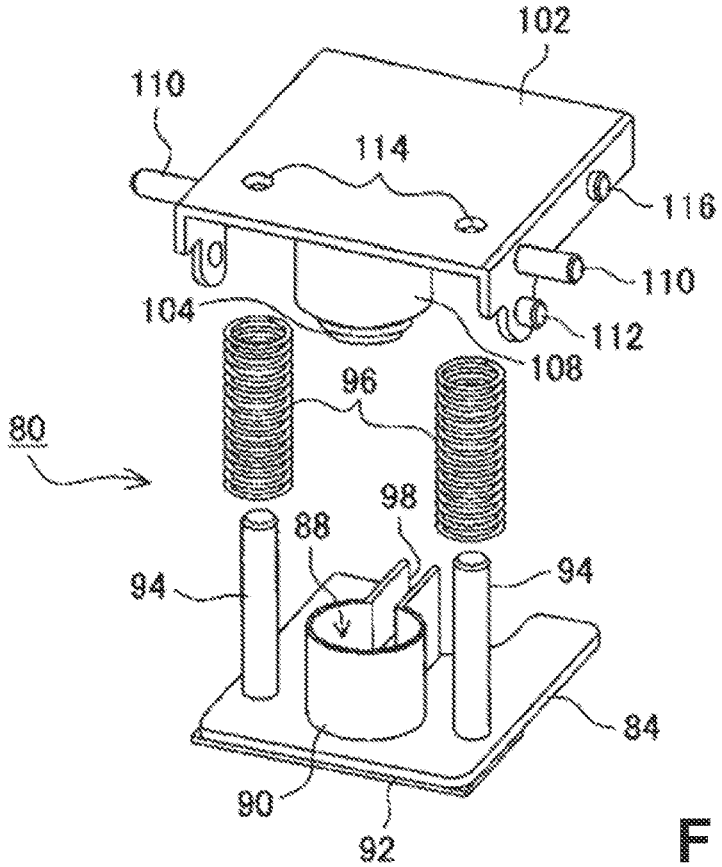
FIG. 4B

FIG. 6A
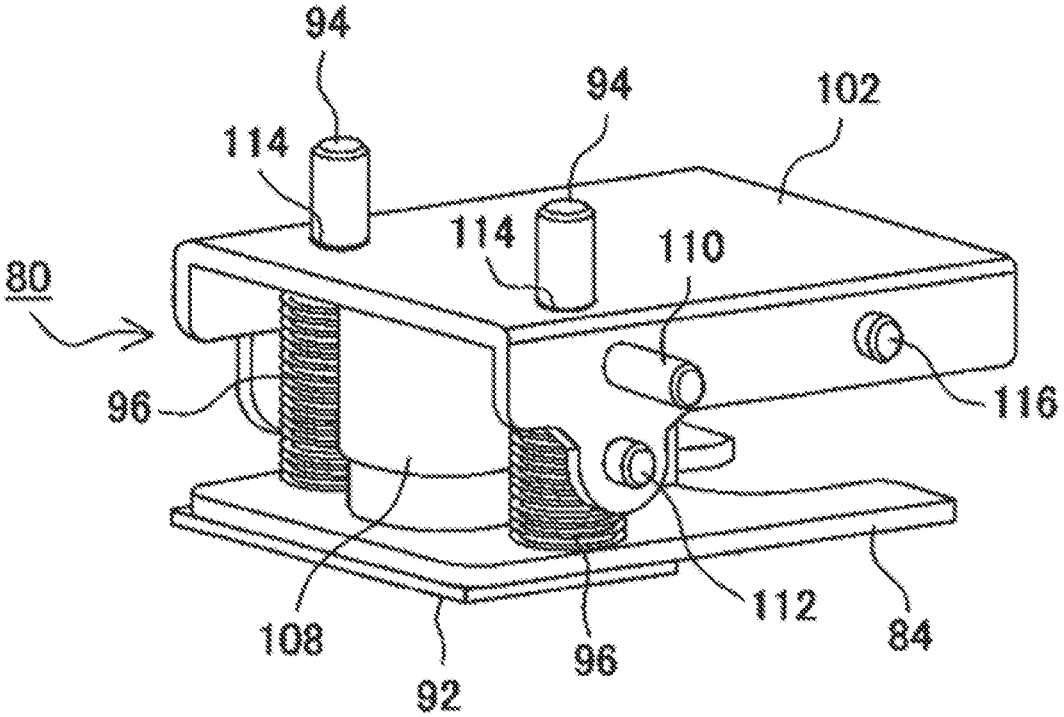
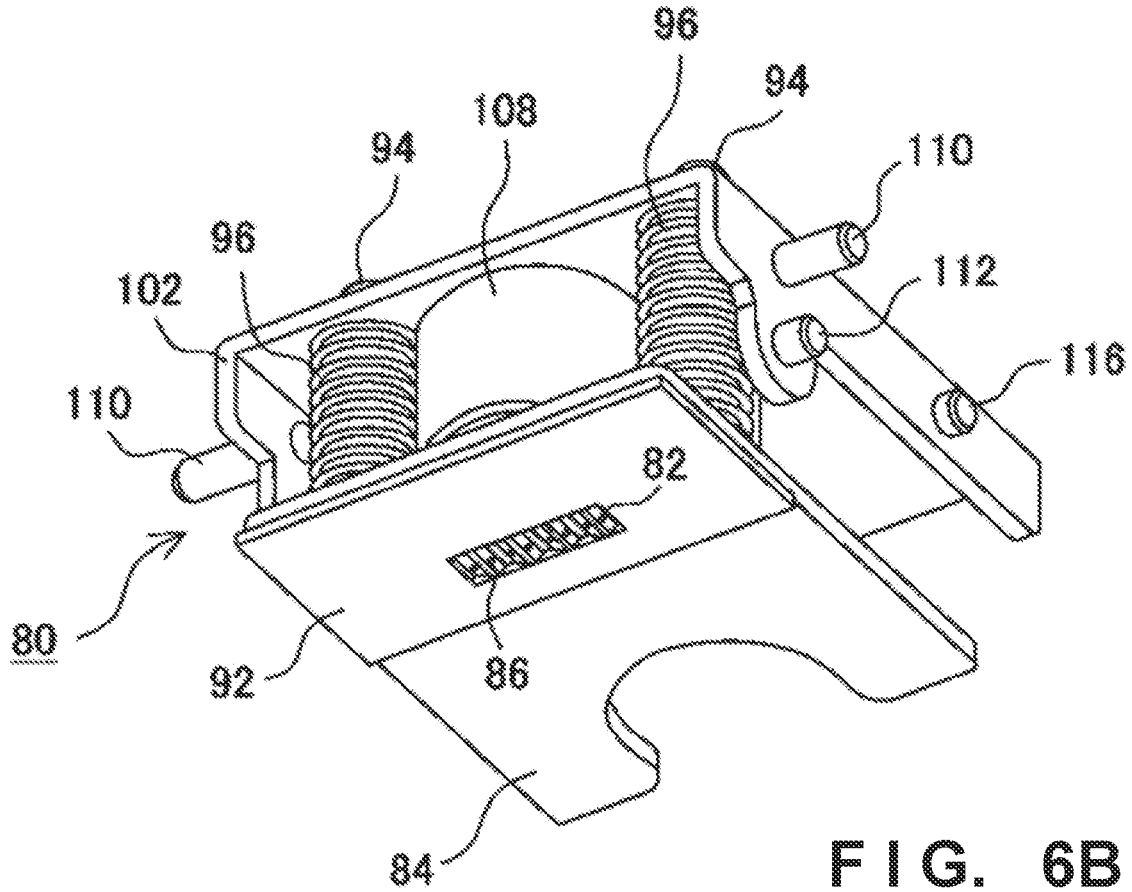
FIG. 6B

SHEET PROCESSING APPARATUS, AND IMAGE FORMING SYSTEM

BACKGROUND OF THE INVENTION

Field of the Invention

The present invention relates to a sheet processing apparatus for performing binding processing for sheets, and an image forming system.

Description of the Related Art

Conventionally, in an image forming apparatus such as a copying machine, a laser beam printer, a facsimile, or a multifunctional peripheral, there is provided a sheet processing apparatus including a binding unit that conveys and places sheets, on each of which an image has been formed, onto a processing tray and performs binding processing for the placed sheet bundle.

As the apparatus, there is known an apparatus that performs binding by pressure-bonding sheets without using any metal staple as a binding member from the viewpoint of power consumption and environmental protection. In this so-called pressure-bonding binding, a load is applied to a pair of groups of concave and convex pressurizing teeth, which mesh with each other, with respect to overlapping sheets to tangle fibers of the sheets, thereby performing binding.

In this pressure-bonding binding, sheets are bound without using any staple. For a few sheets, pressure bonding is possible. However, if the number of sheets increases, the concave and convex pressurizing teeth (pressuring teeth and receiving teeth) are difficult to mesh with each other, thereby weakening a binding force.

To increase the binding force, Japanese Patent No. 3481300 describes a technique of performing pressure bonding by an upper metal mold (upper pressurizing teeth) in which a triangular three-dimensional structure is formed and a lower metal mold (lower pressurizing teeth) that meshes with the upper metal mold after applying a mass of water to the surface of a sheet bundle.

Japanese Patent No. 3502204 describes a technique of adding water before pressure-bonding the sheets of paper in order to make it easy to tangle fibers of the sheets. In addition, Japanese Patent No. 3502204 describes a technique of supplying water along the edge of a sheet during conveyance of the sheet.

Japanese Patent Laid-Open No. 2014-201432 describes the use of an inkjet head that discharges water from a nozzle hole as a water addition mechanism of adding water to a binding region of a sheet to perform pressure-bonding binding. In addition, Japanese Patent Laid-Open No. 2014-201432 describes that a pressure-bonding strength is changed by changing an amount of added water.

Japanese Patent Laid-Open No. 2018-199553 describes a technique in which when a few sheets (two to six sheets) are placed, a normal pressure-boding operation is performed without adding water and when the number of sheets exceeds the above number, pressure boding is performed after adding water.

However, any of these literatures does not mention an arrangement of shortening, by shortening the time taken for a liquid to penetrate into a sheet, the time from when the liquid is applied to the sheet until pressure bonding is performed.

SUMMARY OF THE INVENTION

The present invention in one aspect provides a sheet processing apparatus for performing binding processing for a sheet bundle formed from a plurality of sheets, comprising: an application unit configured to apply a liquid to a sheet wherein the application unit applies the liquid to an outermost sheet of the sheet bundle, and a static surface tension of the liquid is lower than a static surface tension of water; and a binding processing unit configured to bind the sheet bundle, without using a staple, wherein the binding processing unit includes a pair of groups of pressurizing teeth, and the pressurizing teeth clamp and pressurize the sheet bundle, wherein in the sheet bundle, a liquid application region which is applied with the liquid and a pressurizing region which is pressurized by the pressurizing teeth are provided to overlap each other.

Further features of the present invention will become apparent from the following description of exemplary embodiments with reference to the attached drawings.

BRIEF DESCRIPTION OF THE DRAWINGS

FIGS. 4A and 4B are views for explaining the arrangement of the binding unit;

FIGS. 6A and 6B are views for explaining the arrangement of the binding unit;

DESCRIPTION OF THE EMBODIMENTS

Figure 1:
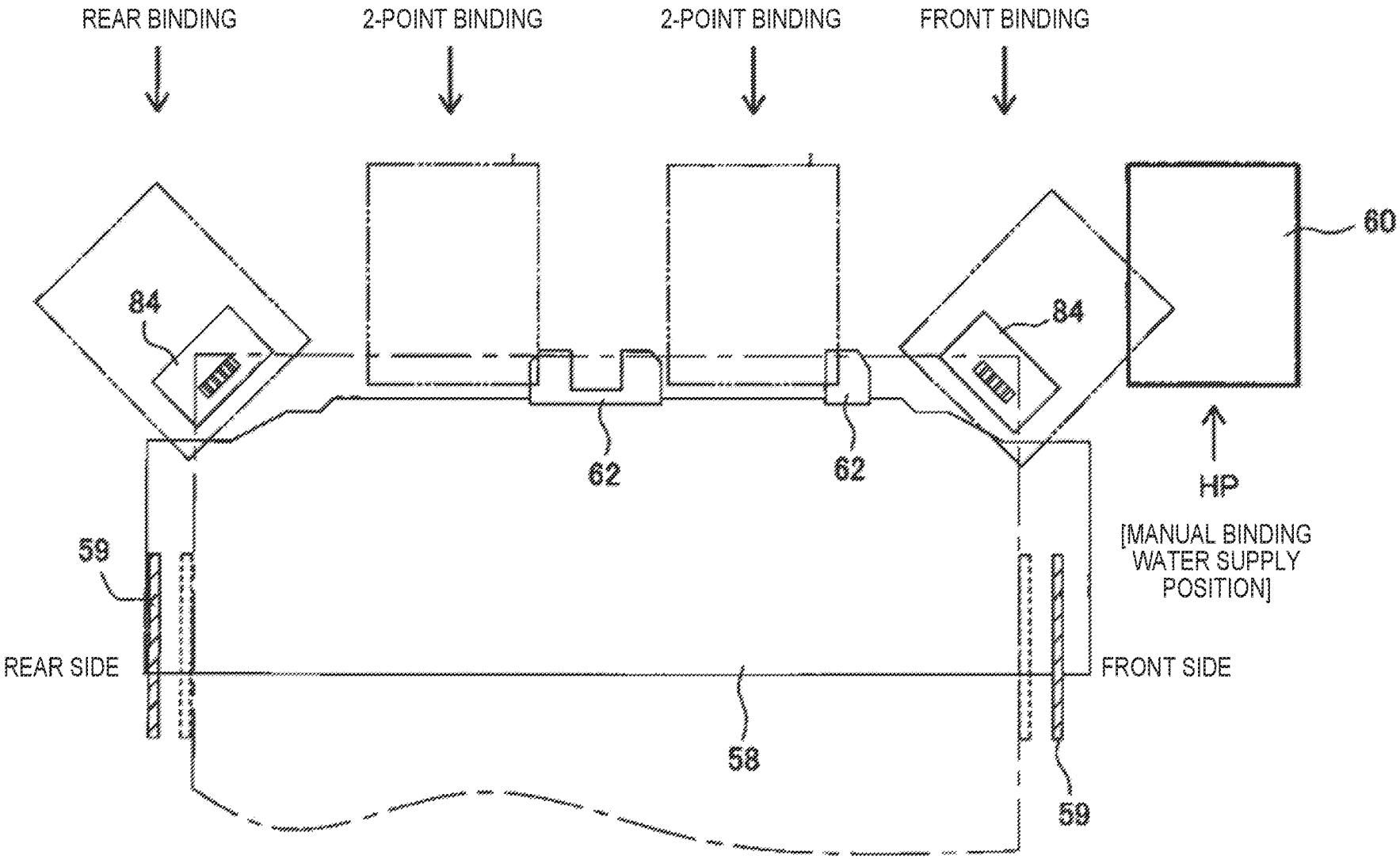
FIG. 1 is a view showing the periphery of a processing tray and a binding unit.

An embodiment will be described in detail below with reference to the accompanying drawings. It should be noted that the following embodiment is not intended to limit the scope of the appended claims. A plurality of features are described in the embodiment. Not all the plurality of features are necessarily essential to the present invention, and the plurality of features may arbitrarily be combined. In addition, the same reference numerals denote the same or similar parts throughout the accompanying drawings, and a repetitive description will be omitted.

As the embodiment of the present invention, a sheet processing apparatus (finisher) incorporated in an image forming main body apparatus will be described. However, various modifications can be made without departing from the scope of the present invention, and all the technical matters included in the technical concept described in the appended claims are the subject matters of the present invention. Note that the image forming main body apparatus is not limited, and a printing mechanism such as an electrostatic mechanism, an offset printing mechanism, an inkjet printing mechanism, or an ink ribbon transfer printing mechanism (thermal transfer ribbon printing, sublimation ribbon printing, or the like) can be adopted.

In this embodiment, a sheet (print medium) indicates a thin material whose fibers are loosened when water penetrates. The structure and mechanism of an apparatus for performing water-addition pressure-bonding binding according to this embodiment will be described in detail later. First, a liquid with permeability higher than that of water, to be used for binding, as the feature of this embodiment will be described in detail.

As a binding method according to this embodiment, fibers forming sheets are loosened and tangled. To efficiently loosen fibers, it is necessary to make water penetrate quickly into sheets to be bound. To achieve this, this embodiment has a feature that a liquid is an aqueous solution with a surface tension lower than that of water.

The surface tension of a liquid serves as an index of permeability into a sheet. A liquid with a low surface tension penetrates into a sheet more easily than a liquid with a high surface tension.

As a method of adjusting the surface tension of the liquid, there are known a method using a surfactant and a method using a solvent. If the surface tension is adjusted using a surfactant, the surface tension can be adjusted by adding a small amount of the surfactant. On the other hand, if the surface tension is adjusted using a solvent, it is necessary to add an amount of the solvent larger than that of the surfactant. Furthermore, since the solvent has high moisture retention, it prevents evaporation of water after sheets are bound. Therefore, it takes time to dry the bound sheets. For the above reasons, in this embodiment, it is preferable to adjust the surface tension of the liquid using the surfactant. In general, the surface tension is a value measured by the Wilhelmy method as a static surface tension. The value of the static surface tension of water is "72.8 mN/m", and a liquid with a static surface tension of a lower value is used in this embodiment. More preferably, a liquid with a surface tension of "45.0 mN/m" or less is used. The static surface tension indicates a surface tension when equilibrium is reached at the interface of a liquid and a gas by the lapse of time.

Furthermore, in this embodiment, the value of the dynamic surface tension of the liquid is preferably low. The dynamic surface tension serves as an index different from the above-described static surface tension.

The static surface tension corresponds to the value of the surface tension when equilibrium is reached after a material exhibiting the surface active property is fully oriented on the interface between the liquid and the gas. On the other hand, the dynamic surface tension indicates the surface tension measured within the time until the material exhibiting the surface active property is fully oriented. That is, the dynamic surface tension serves as an index for a temporal change of the surface tension. Alternatively, the dynamic surface tension can be said as the value of the surface tension after a predetermined time since generation of a gas-liquid interface. The dynamic surface tension can be measured by the maximum bubble pressure method, the drop volume method, or the like.

In this embodiment, it is desirable that a liquid quickly penetrates into a sheet in order to shorten the time taken to perform binding. Therefore, a liquid whose surface tension becomes low in a short time is suitable for this embodiment. Although the measurement time of the dynamic surface tension is not particularly limited, a result of performing measurement within 100 msec after generation of the gas-liquid interface is preferably lower, and a result of performing measurement within 50 msec is more preferably lower. That is, the liquid used in this embodiment is preferably a liquid whose surface tension changes to a value close to the static surface tension in a short time.

The value of the surface tension of water after 100 msec is "72.5 mN/m", and the value of the surface tension after 50 msec is "72.3 mN/m". The liquid used in this embodiment preferably has a surface tension lower than these values. As described above, the liquid is preferably a liquid whose surface tension changes to a value close to the static surface tension in a short time.

Furthermore, in this embodiment, the surface tension of the liquid is preferably equal to or lower than the critical surface tension of the sheets to be bound. The critical surface tension indicates a surface tension when the contact angle of the liquid contacting a solid is 0°. If the surface tension of the liquid is equal to or lower than the critical surface tension of the contacting solid, a tendency that the liquid actively spreads with respect to the solid is indicated. Therefore, the liquid readily penetrates into the sheet.

The critical surface tension will be described. As a method of measuring the critical surface tension of a target solid, there is provided a general method proposed by Zisman. For each of a plurality of saturated hydrocarbon liquids with different surface tensions ($\gamma$), a contact angle $\theta$ with the target is measured. Then, the relationship between the surface tension ($\gamma$) and the cosine (COS $\theta$) of the contact angle is plotted. Based on the result of plotting, the value of the surface tension ($\gamma$) extrapolated so that the value of the cosine (COS $\theta$) of the contact angle becomes 1 indicates the critical surface tension of the target.

However, in this embodiment, since a print medium focusing on plain paper (a general printing sheet) as a target which the liquid is made to contact has a critical surface tension of a high value, the above-described measurement method using the saturated hydrocarbon liquids may not implement correct measurement. In this embodiment, therefore, the critical surface tension is measured using solutions obtained by mixing water and ethanol at a plurality of mixing ratios.

As a result of the measurement, the critical surface tension of the plain paper has a value of "45 mN/m". The surface tension of the liquid used in this embodiment preferably has a value equal or lower than this value. Note that if there are a plurality of types of sheets to be bound, the surface tension of the liquid is preferably made to be equal to or lower than the lowest value of the critical surface tension.

An organic solvent for adjusting the surface tension to be preferably used in this embodiment is not particularly limited as long as it can be dissolved in water. Examples of the organic solvent are polyhydric alcohols such as 1,3-butyl glycol, 3-methyl-1,3-butyl glycol, triethylene glycol, polyethylene glycol, 1,5-pentanediol, 1,6-hexanediol, 1,2-hexanediol, 2-ethyl-1,3-hexanediol, ethyl-1,2,4-butanetriol, 1,2,3-butanetriol, and 3-methyl-1,3,5-pentanetriol, polyhydric alcohol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether, polyhydric alcohol aryl ethers such as ethylene glycol monophenyl ether and ethylene glycol monobenzyl ether, nitrogen-containing heterocyclic compounds such as 2-pyrrolidone, N-methyl-2-pyrrolidone, N-hydroxyethyl-2-pyrrolidone, 1,3-dimethyl imidazolidinone, ε-Caprolactam, and γ-Butyrolactone, amides such as formamide, N-methyl formamide, and N,N-dimethylformamide, amines such as monoethanolamine, diethanolamine, and triethylamine, sulphur-containing compounds such as dimethyl sulfoxide, sulfolane, and thiodiethanol, propylene carbonate, and ethylene carbonate. Each of these water-soluble organic solvents can be used singly, or two or more of them can be mixed and used. To achieve a predetermined surface tension, an amount of a solvent to be added is preferably smaller.

The surfactant for adjusting the surface tension, which is preferably used in this embodiment, is not particularly limited. Examples of the surfactant are as follows. Note that a single surfactant or a plurality of surfactants may be used.

[Nonionic Surfactant] polyoxyethylene alkyl ether, polyoxyethylene fatty acid ester, polyoxyethylene alkyl phenyl ether, a polyoxyethylene/polyoxypropylene block polymer, fatty acid diethanolamide, an acetylene glycol ethylene oxide adduct, an acetylene glycol-based surfactant, and the like.

[Anionic Surfactant] polyoxyalkylene alkyl ether sulfuric acid ester salt, polyoxyalkylene alkyl ether sulfonic acid salt, polyoxyalkylene alkyl phenyl ether sulfuric acid ester salt, polyoxyalkylene alkyl phenyl ether sulfonic acid salt, alpha-sulfofatty acid ester salt, alkyl benzene sulfonic acid salt, alkyl phenol sulfonic acid salt, alkyl naphthalene sulfonic acid salt, alkyltetralin sulfonic acid salt, dialkylsulfosuccinic acid salt, and the like.

[Cationic Surfactant] alkyltrimethylammonium salt, dialkyldimethylammonium chloride, and the like.

[Amphoteric Surfactant] alkylcarboxybetaine and the like.

Among them, an acetylene glycol-based surfactant, polyoxyethylene alkyl ether, and the like can improve the ink discharge stability, and are thus particularly, preferably used. As the acetylene glycol-based surfactant, (an ethylene oxide adduct of 2,4,7,9-tetramethyl-5-decyne-4,7-diol) is preferable.

The sheet used in the sheet processing apparatus according to this embodiment is not particularly limited, and may be any paper generally used for printing. As an example, so-called plain paper or PPC paper with a basis weight of 100 g/cm$^2$ or less is preferably used. More preferably, any sheet with a basis weight of 90 g/cm$^2$ or less can preferably be used. If the basis weight is larger, the sheet is thick, and it is thus difficult to obtain the effect of this embodiment.

The structure and mechanism of a binding unit, which binds sheets using the liquid, of the sheet processing apparatus using this embodiment will be described. Note that in the sheet processing apparatus according to this embodiment, an arrangement capable of coping with both a case in which the liquid is used in accordance with the number of sheets to be bound and a case in which sheets are bound without using the liquid according to this embodiment will be explained. This embodiment is applied to binding when the liquid is used, as a matter of course.

FIG. 1 is a view showing the arrangement of the periphery of the binding unit that binds sheets by the finisher. As shown in FIG. 1, alignment plates 59 that move a sheet in a width direction intersecting a sheet conveyance direction every time the sheet is conveyed from a conveyance roller (not shown) are provided on a processing tray 58 on which the sheet is placed. The alignment plates 59 are provided to be moved by an alignment plate motor 59M shown in FIG. 19 to sandwich the sheet by the two sides in the sheet width direction. This moves the alignment plates 59 in a direction of narrowing the spacing between them, thereby performing alignment in the sheet width direction. On the processing tray 58, a discharge port (not shown) and reference stoppers 62 which are inclined downward and used to make a sheet switch-back conveyed by a return paddle or the like abut against their end portions are arranged.

A binding unit 60 as a binding processing unit shown in FIG. 1 adopts a pressure-boding binding of binding sheets by performing pressure bonding by pressuring teeth without using any metal staple, and can also perform so-called water-addition pressure-bonding binding of binding sheets by adding a liquid to the sheet at the time of pressure bonding. Note that application of a liquid containing water may be expressed as "water addition" for the sake of descriptive convenience hereinafter. At the time of manual binding or water supply, the binding unit 60 is located at an HP position (home position) shown in FIG. 1. Furthermore, at the time of front binding, rear binding, or 2-point binding, the binding unit 60 is moved to each corresponding position.

[Arrangement for Water-Addition Pressure-Bonding Binding]

Figure 2A:
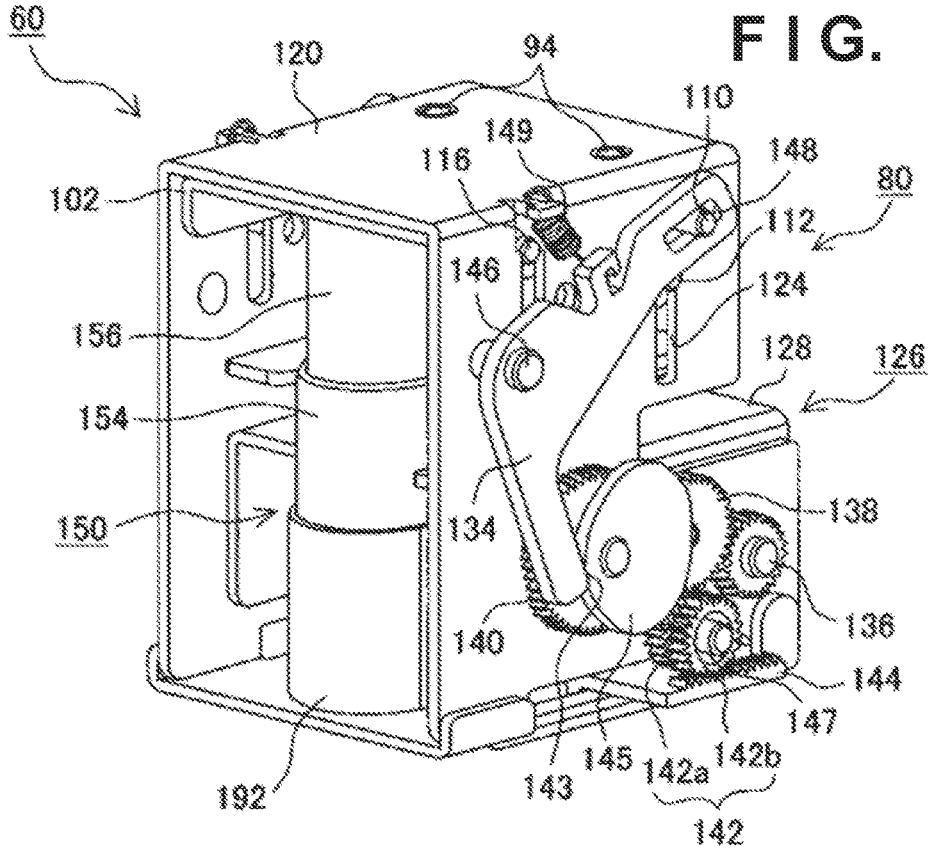
FIGS. 2A and 2B are views for explaining the arrangement of the binding unit.
Figure 2B:
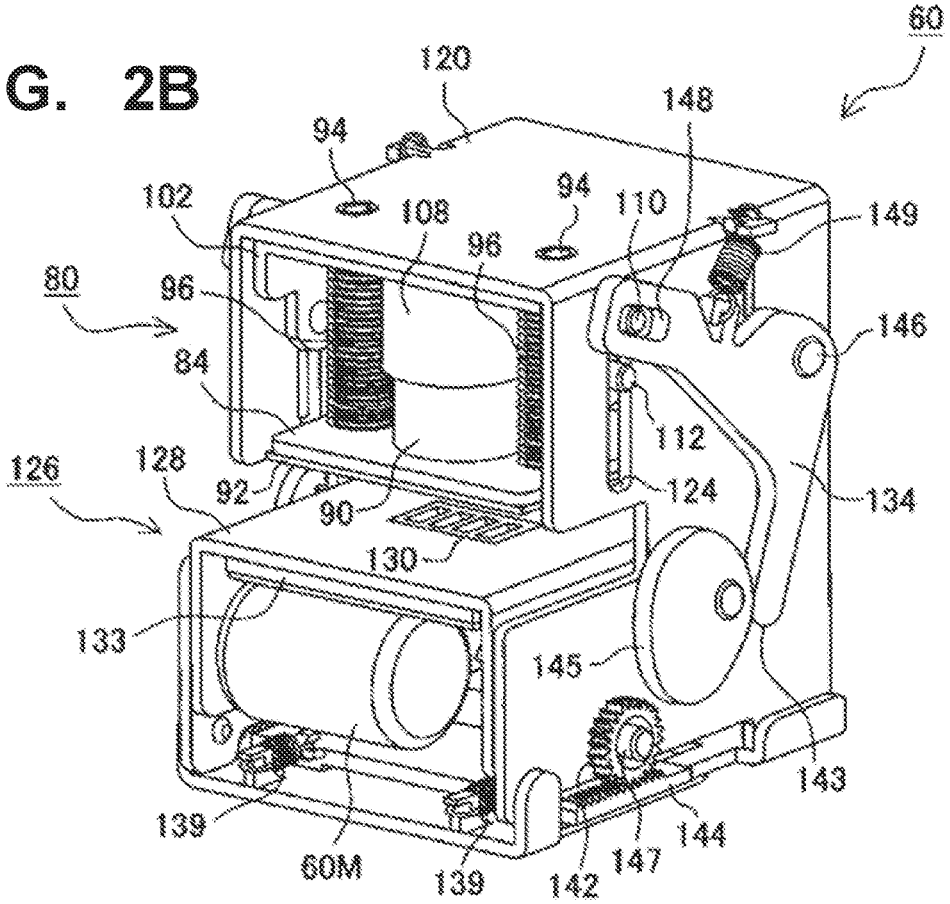
Figure 3A:
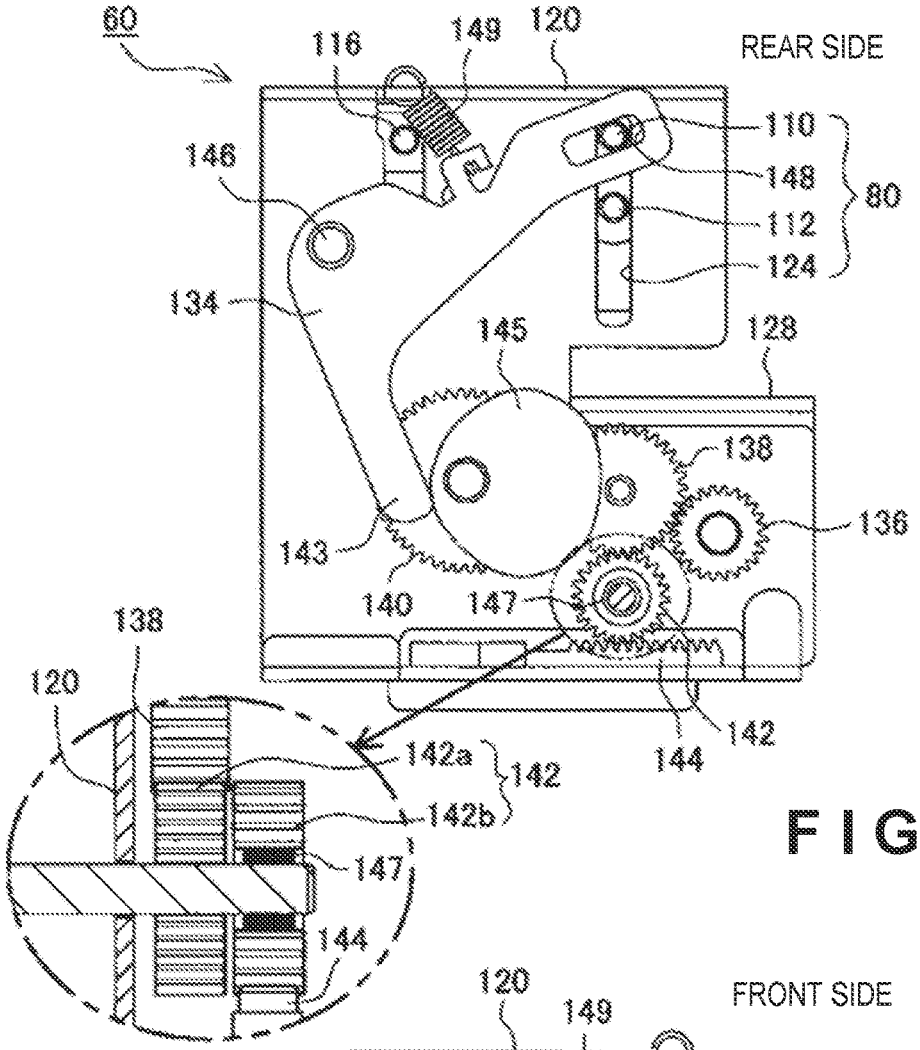
FIGS. 3A and 3B are views for explaining the arrangement of the binding unit.
Figure 3B:
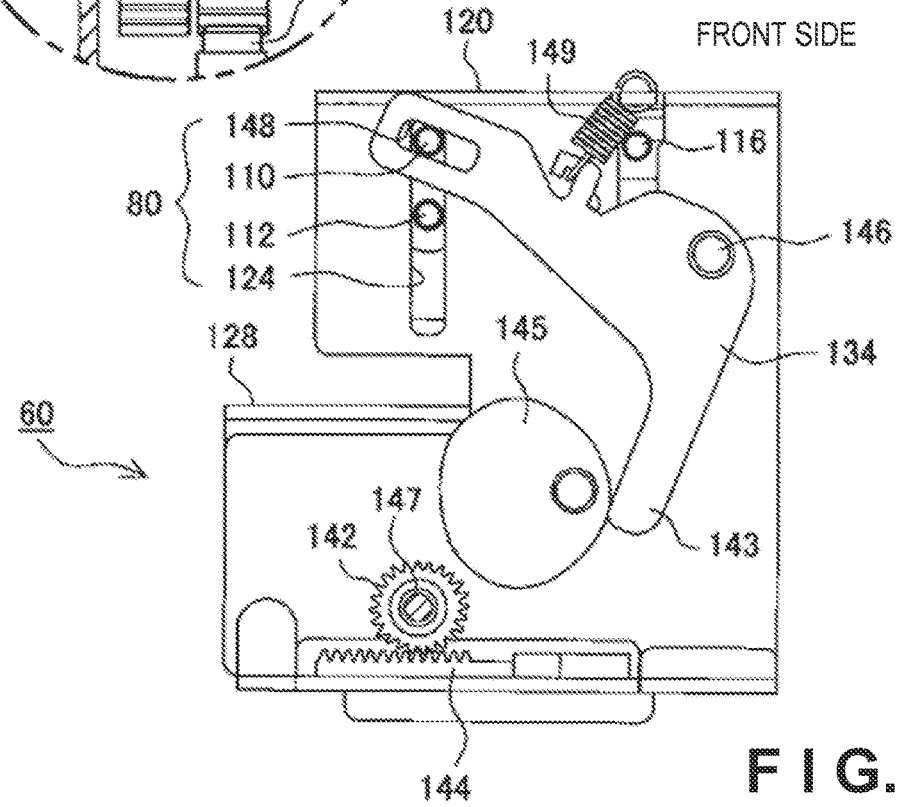

The binding unit 60 that applies the liquid to the binding position of the sheet and then performs pressure bonding will be described with reference FIG. 2A and subsequent drawings. FIGS. 2A and 2B are perspective views of the (water-addition pressure-bonding) binding unit 60. FIG. 2A shows the rear side and FIG. 2B shows the front side. FIGS. 3A and 3B are side views of the binding unit 60. FIG. 3A is a view when viewed from the rear side of the sheet processing apparatus and FIG. 3B is a view when viewed from the front side of the sheet processing apparatus.

Figure 5A:
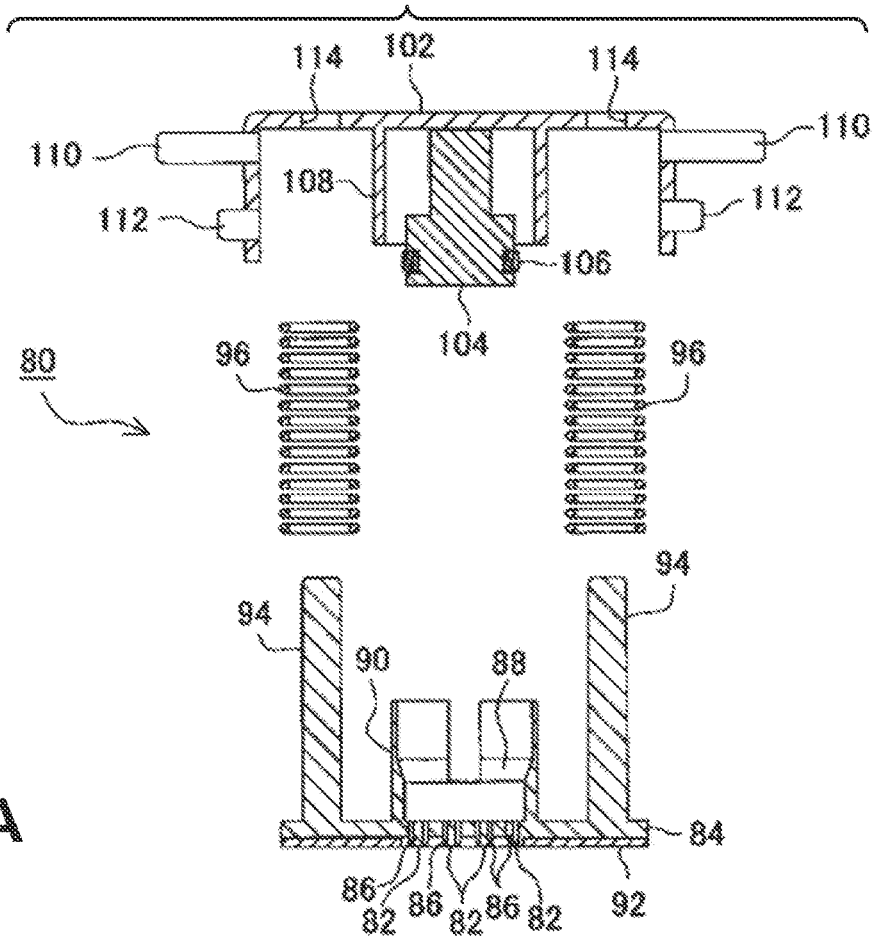
FIGS. 5A and 5B are views for explaining the arrangement of the binding unit.
Figure 5B:
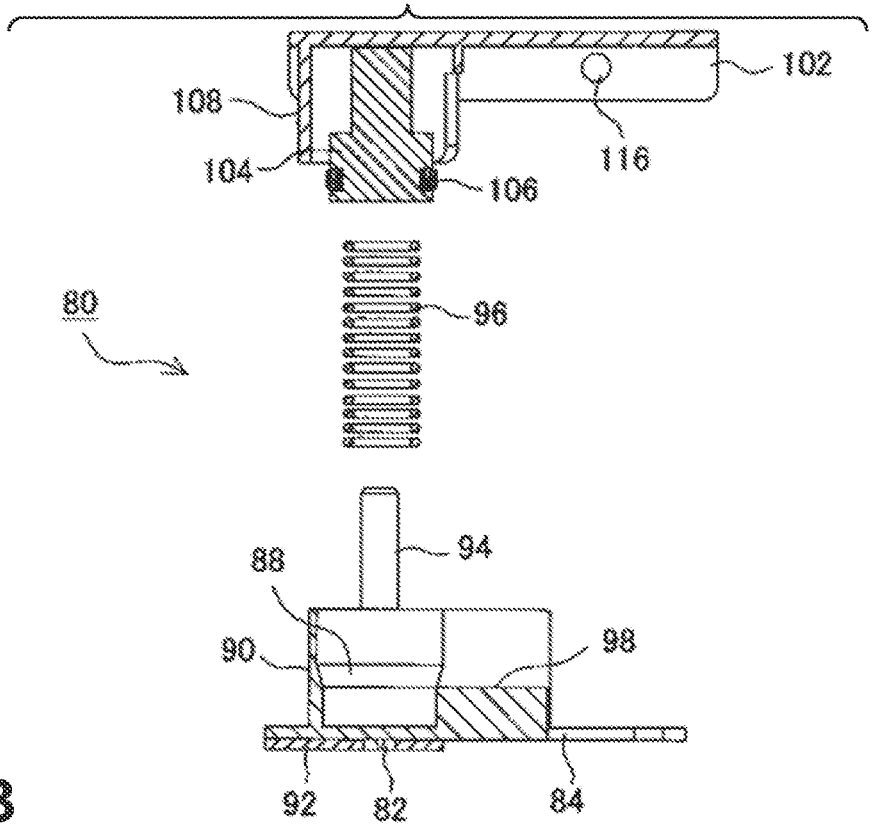

As shown in FIGS. 2A, 2B, 3A, and 3B, the binding unit 60 includes a water addition pressurizing portion 80 that adds water to the sheet and includes a group of vertically moving pressurizing teeth 82 shown in FIGS. 5A and 5B of a pair of groups of pressurizing teeth, a receiving teeth portion 126 that includes receiving teeth 130, and a liquid replenishing pump portion (liquid replenishing pump unit) 150 that adds water to the sheet. One group of pressurizing teeth (upper pressurizing teeth) 82 constituting the pair of groups of pressurizing teeth is provided in a pressurizing teeth support portion 84 by being surrounded by an elastic member 92 formed by a rubber plate or the like.

The receiving teeth 130 as the other group of pressurizing teeth (lower pressurizing teeth) are supported by a receiving teeth support portion 128 to form the receiving teeth portion 126. The pressurizing teeth 82 and the receiving teeth 130 are located to sandwich the sheets (sheet bundle) placed on the processing tray 58. When performing binding processing, the pressurizing teeth 82 abut against the outermost sheet of the sheet bundle, and the receiving teeth 130 abut against the lowermost sheet of the sheet bundle. Then, the pressurizing teeth 82 and the receiving teeth 130 pressurize the sheet bundle.

As shown in FIG. 3B, a cylinder 90 forming a liquid reservoir 88 shown in FIGS. 5A and 5B that holds the liquid to be applied to the sheet is arranged on the rear side of the pressurizing teeth 82. Above the cylinder 90, a cylinder guide 108 is located on the outer side in the circumferential direction of a pressurizing piston 104 (to be described later). The pressurizing piston 104 and the cylinder 90 form a pressurizing member (water addition member) of the liquid to be applied.

On the lower side, the receiving teeth 130 are supported by the receiving teeth support portion 128, and the receiving teeth support portion 128 also supports the lower surface of the sheet. A drain tray 133 that receives the residual liquid applied to the sheet is arranged below the receiving teeth support portion 128.

As is apparent from FIG. 3A, the liquid replenishing pump unit 150 serving as a liquid replenishing pomp portion that replenishes the liquid to the liquid reservoir 88 is stored in an outer frame 120 of the binding unit 60 in adjacent to the rear sides of the pressurizing teeth 82 and the receiving teeth 130. Although the liquid replenishing pump unit 150 will be described later, the liquid replenishing pump unit 150 includes a liquid replenishing piston portion 154 that supplies the liquid to the liquid reservoir 88, a liquid replenishing head portion 156 that moves the liquid replenishing piston portion 154, and a liquid replenishing tank portion 152 formed by a liquid replenishing tank 174 that stores the liquid to be replenished. In FIG. 2A, a pump holding cover 192 that covers the liquid replenishing tank 174 can be seen.

Compression springs 96 are arranged on the left and right of the cylinder 90 forming the liquid reservoir 88 between a press plate 102 that vertically moves the pressurizing teeth 82 and the pressurizing teeth support portion 84 that supports the pressurizing teeth 82 and the elastic member (rubber plate) 92.

The press plate 102 is driven by the driving motor (the binding motor 60M shown in FIG. 19) arranged in a space partitioned by the receiving teeth support portion 128 and the outer frame 120. Driving from the binding motor 60M to the press plate 102 is configured as follows. That is, an intermediate gear 138 is engaged with a motor output shaft gear 136 provided in the output shaft of the binding motor 60M as a driving motor in the outer frame 120 on the rear side, as shown in FIGS. 2A and 3A.

Rotation of the intermediate gear 138 is transferred to a cam gear 140 that rotates on a moving cam 145 and a pinion gear 142 that moves a support rack 144 to a position which is not a position where the liquid replenishing tank bottom portion 175 is supported. Note that the pinion gear 142 includes a pinion gear 142*a* that rotates together with the shaft by receiving transfer from the intermediate gear 138 and a pinion gear 142*b* that transfers the rotation to the support rack 144 via a one-way clutch 147 with the rotation shaft. This selects, based on the rotation direction of the binding motor 60M, whether to move the support rack 144, and operates the liquid replenishing piston portion 154 only when necessary. This point will be described later.

The moving cams 145 are arranged on the front and rear sides of the outer frame 120. Pivot arms 134 that are moved by the moving cams 145 are attached to both the sides to pivot about arm fulcrums 146 attached to the outer frame 120. Each pivot arm 134 is maintained in a state in which an arm proximal end 143 abuts against the moving cam 145 all the time by a return spring 149 stretched with the outer frame 120.

On the other hand, an upper moving pin 110 of the press plate 102 is inserted into arm distal end slits 148 on the distal ends of the pivot arms 134. Therefore, if the moving cams 145 rotate, the distal ends of the pivot arms 134 vertically move to move the press plate 102 vertically. Note that on the front side (the side of the pressurizing teeth 82) of the press plate 102, the upper moving pin 110 and a lower moving pin 112 of the press plate 102 are inserted into guide slits 124 of the outer frame 120.

On the rear side (the side of the liquid replenishing pump unit 150) of the press plate 102, a rear guide pin 116 is also inserted into the guide slits 124 of the outer frame 120. Since the upper moving pin 110 is also inserted into the arm distal end slits 148 of the pivot arms 134, the press plate 102 is configured to be vertically moved by the pivot arms 134. Therefore, the press plate 102 and the pivot arms 134 form a moving member.

The press plate 102 vertically moves the water addition pressurizing portion 80. This will be described with reference to FIGS. 4A to 7B. FIGS. 4A and 4B are perspective views of the water addition pressurizing portion 80 of the binding unit. FIG. 4A is a perspective view when viewed from the side and FIG. 4B is a perspective view when viewed from slightly above. FIGS. 5A and 5B are sectional views for explaining the water addition pressurizing portion 80. FIG. 5A shows a front view and FIG. 5B shows a side view.

The water addition pressurizing portion 80 includes the press plate 102, the pressurizing teeth support portion 84, and the compression springs 96 existing between the press plate 102 and the pressurizing teeth support portion 84. On the side of the pressurizing teeth support portion 84 which contacts the sheet, the pressurizing teeth 82 and the elastic member 92 formed from a rubber plate that surrounds the pressurizing teeth 82 are provided. On the rear side (pressurizing teeth rear side) of the pressurizing teeth 82, the cylinder 90 formed integrally with the pressurizing teeth support portion 84 is provided, and guide bars 94 around which the compression springs 96 are wound are provided on both the sides of the cylinder 90. The distal ends of the guide bars 94 are inserted through guide holes 114 of the press plate 102 all the time.

As shown in FIGS. 5A and 5B, the liquid reservoir 88 that holds the liquid to be applied to the sheet is formed in a portion of about ⅓ of the height of the cylinder 90. In the cylinder 90, a notch is formed as a replenishment port 98 that receives the liquid from the liquid replenishing pump unit 150 (to be described later). In FIGS. 5A and 5B, the pressurizing teeth 82 are also integrally formed, and supply holes (supply tubes) 86 are opened in the pressurizing teeth 82 so as to apply the liquid of the liquid reservoir 88 to the sheet.

Above the cylinder 90, the pressurizing piston 104 that is pressurized and moved so as to apply the liquid of the liquid reservoir 88 from the supply holes of the pressurizing teeth 82 by being inserted into the cylinder 90 to pressurize the liquid is located. This pressurizing piston 104 is fixed to the press plate 102 at the upper end. A piston packing 106 is circumferentially wound around the insertion portion of the pressurizing piston 104 into the cylinder 90. The piston packing 106 shown in FIGS. 5A and 5B is wound around one portion. However, if the piston packing 106 is wound around each of two or more portions, pressure when applying the liquid can be made high.

The moving cylinder guide 108 is provided outside the cylinder 90 in the press plate 102 to make it possible to smoothly insert the pressurizing piston 104 and perform an application operation of pressurizing the liquid. The guide holes 114, and the upper moving pin 110, the lower moving pin 112, and the rear guide pin 116 all of which are inserted into the guide slits 124 of the outer frame 120 are stationarily provided in the press plate 102. Among them, the upper moving pin 110 is extended outward longer than the remaining pins. This is to make it possible to insert the upper moving pin 110 into the arm distal end slits 148 of the pivot arms 134 that pivot outside the outer frame 120.

FIGS. 6A, 6B, 7A, and 7B show a state in which the water addition pressurizing portion 80 having the above arrangement is compressed by the pivot arms 134. FIG. 6A is a perspective view when viewed from slightly above, and FIG. 6B is a perspective view when viewed from below. The operation of the pivot arm 134 for setting this compressed state will be described later with reference to FIGS. 14A to 14C and FIGS. 13A to 13C.

In the views of the compressed state, the press plate 102 abuts against the receiving teeth support portion 128 by the pivot arms 134, the compression springs 96 wound around the guide bars 94 are compressed, and the guide bars 94 protrude from the guide holes 114. FIG. 6B is a view when viewing this state from the side of the receiving teeth support portion 128. The pressurizing teeth 82 provided with the supply holes (supply tubes) 86 are surrounded by the elastic member 92 formed by a rubber plate or the like. This is done to prevent the liquid, applied to a portion except for a range where pressure bonding is performed by the pressurizing teeth 82, from spreading when the liquid of the liquid reservoir 88 is applied by the pressurizing piston 104 after the pressurizing teeth support portion 84 presses the sheet bundle.

Figure 7A:
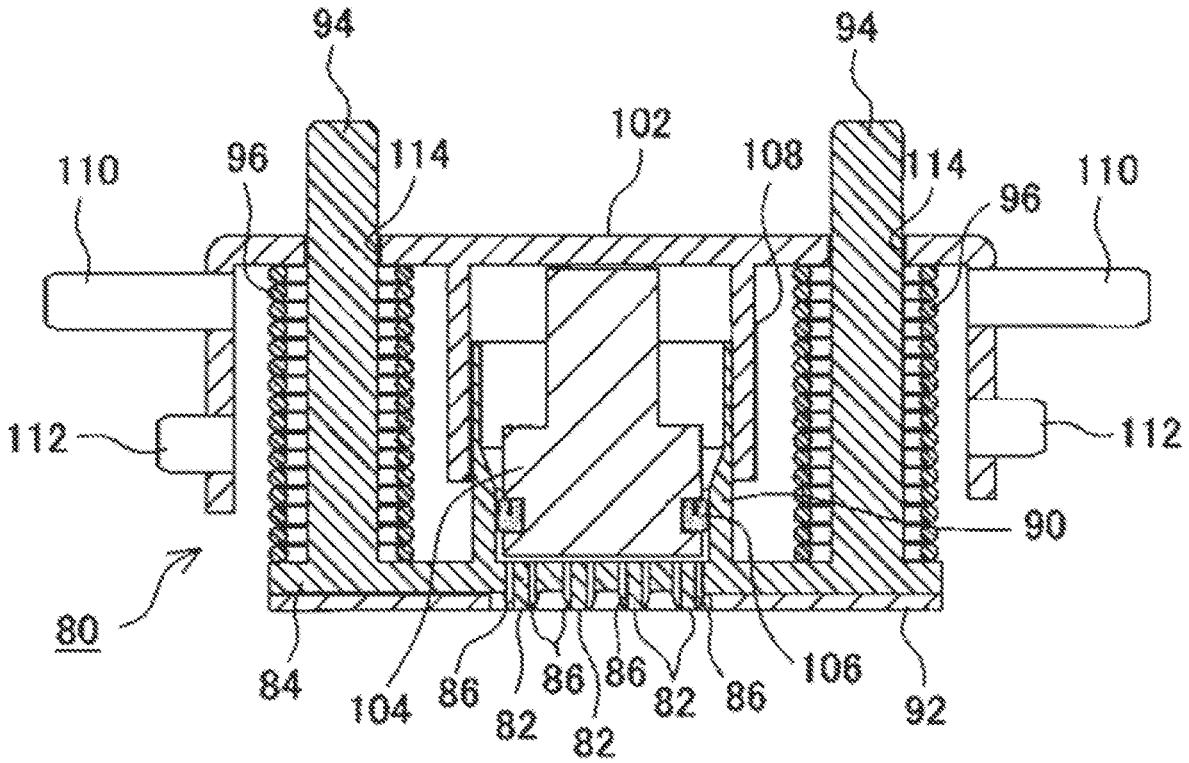
FIGS. 7A and 7B are views for explaining the arrangement of the binding unit.
Figure 7B:
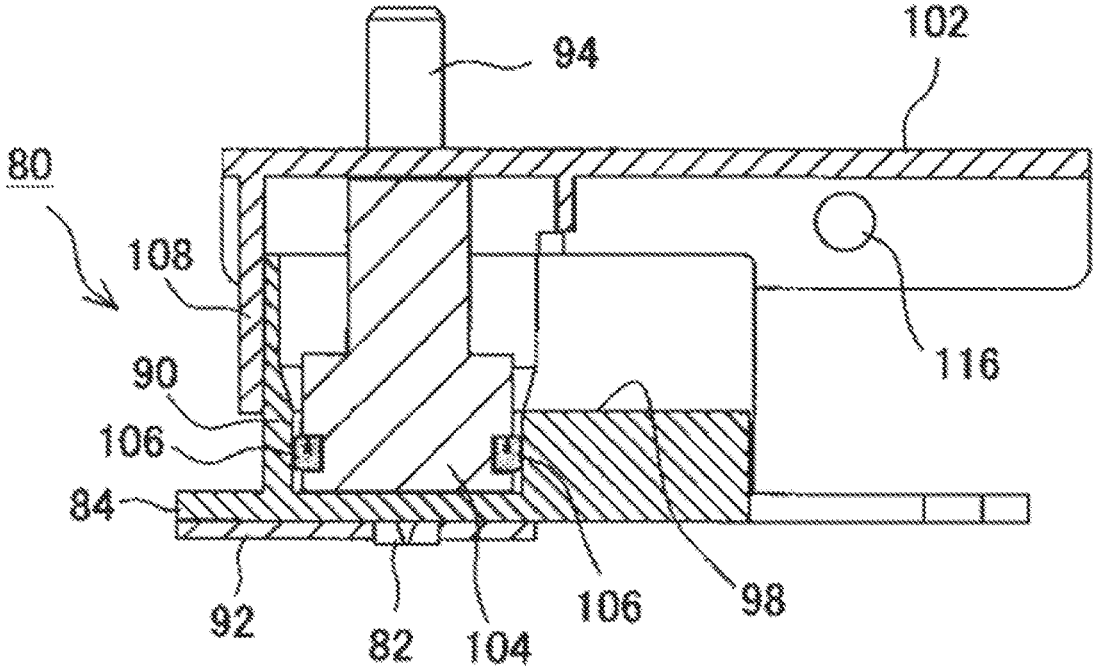

FIGS. 7A and 7B are sectional views of the water addition pressurizing portion 80. FIG. 7A is a front cross-sectional view of the cylinder 90 and the guide bars 94. FIG. 7B is a sectional view when cutting the cylinder 90 in a direction intersecting FIG. 7A. In FIGS. 7A and 7B, the liquid held in the liquid reservoir 88 of the cylinder 90 is applied to the outermost sheet of the sheet bundle by the pressurizing piston 104 through the supply holes (supply tubes) 86 of the pressurizing teeth 82, and penetrates into the sheet bundle. The sheets are pressed by receiving the force of the press plate 102 by the pressurizing piston 104 and pressure-bonded so as to mesh, with the receiving teeth 130, the sheet bundle into which the liquid has penetrated.

Note that the cylinder 90 is formed to have an inner diameter which is decreased as the pressurizing piston 104 moves from above, and the liquid reservoir 88 that holds the liquid to be applied to the sheet is formed in a portion of about ⅓ of the height of the cylinder 90, as described above. The liquid reservoir 88 is pressurized by the pressurizing piston 104 from the position, thereby applying the liquid. On the upper side, the liquid discharged and replenished from the liquid replenishing pump unit 150 is received from the replenishment port 98 into the liquid reservoir 88, thereby waiting for the next operation of the pressurizing piston 104. Therefore, the amount of liquid applied to the sheet at once corresponds to the amount of liquid held in the liquid reservoir 88.

[Liquid Replenishing Pump Portion]

The liquid replenishing pump unit 150 as a liquid replenishing pump portion that replenishes the liquid to the liquid reservoir 88 through the replenishment port 98 will be described next with reference to FIGS. 8 to 10. The liquid replenishing pump unit 150 is internally provided in the outer frame 120 of the binding unit 60, similar to the pressurizing teeth support portion 84 and the receiving teeth portion 126, as already described with reference to FIGS. 2A and 2B. Therefore, it is unnecessary to lay a liquid replenishing pipe and the like from the outside of the binding unit 60, and the apparatus is easy to deal with and is compact.

The liquid replenishing pump unit 150 will be described with reference to the accompanying drawings. FIG. 8 is a sectional view for explaining the liquid replenishing pump unit 150. FIG. 9 is an exploded perspective view of the liquid replenishing piston portion 154 as an important constituent element of the liquid replenishing pump unit 150, and an enlarged view for explaining the liquid replenishing piston portion 154. FIG. 10 is an enlarged view for explaining a water discharge state.

Figure 8:
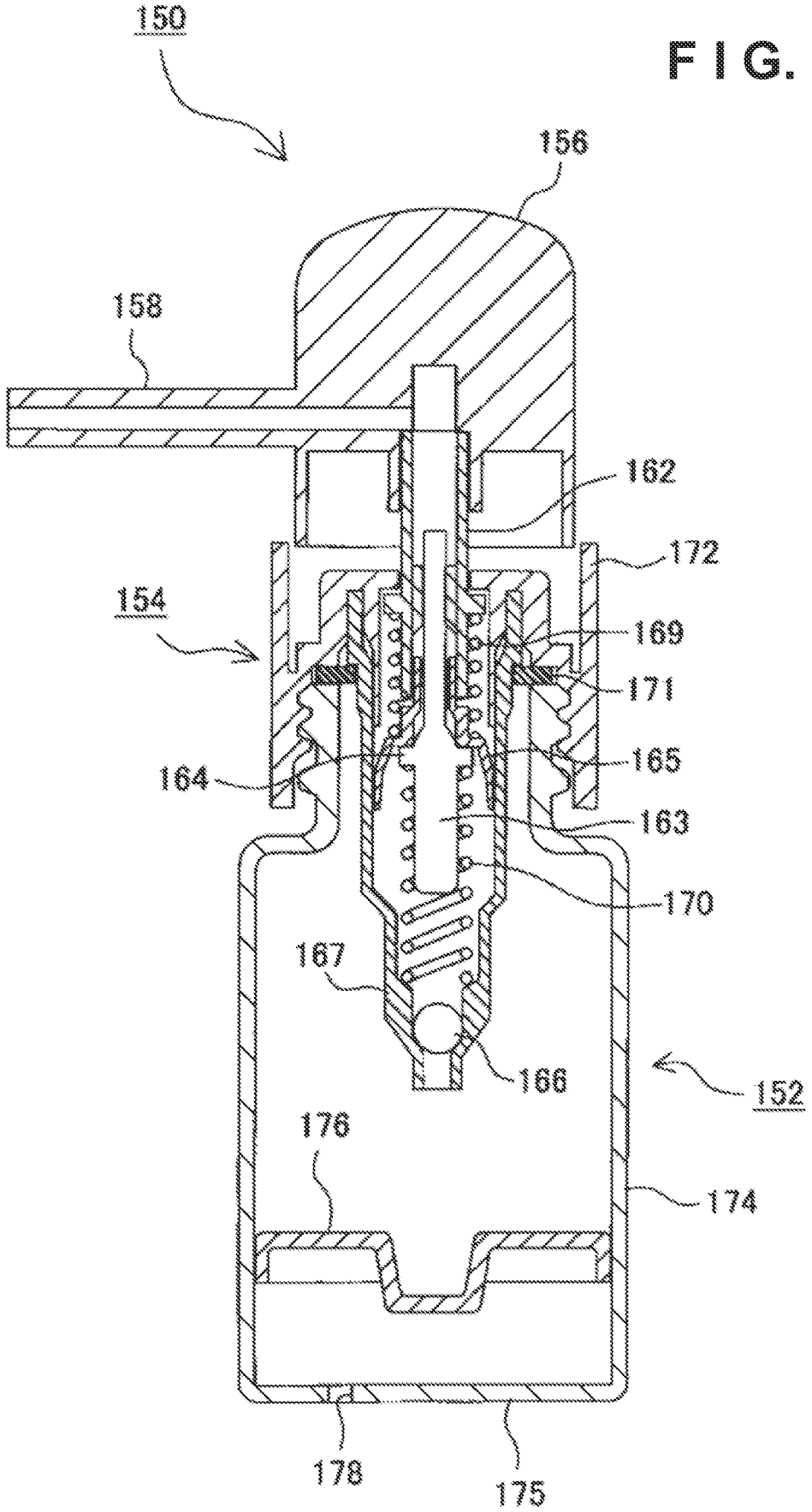
FIG. 8 is a view for explaining the arrangement of a liquid replenishing pump unit.
Figure 9:
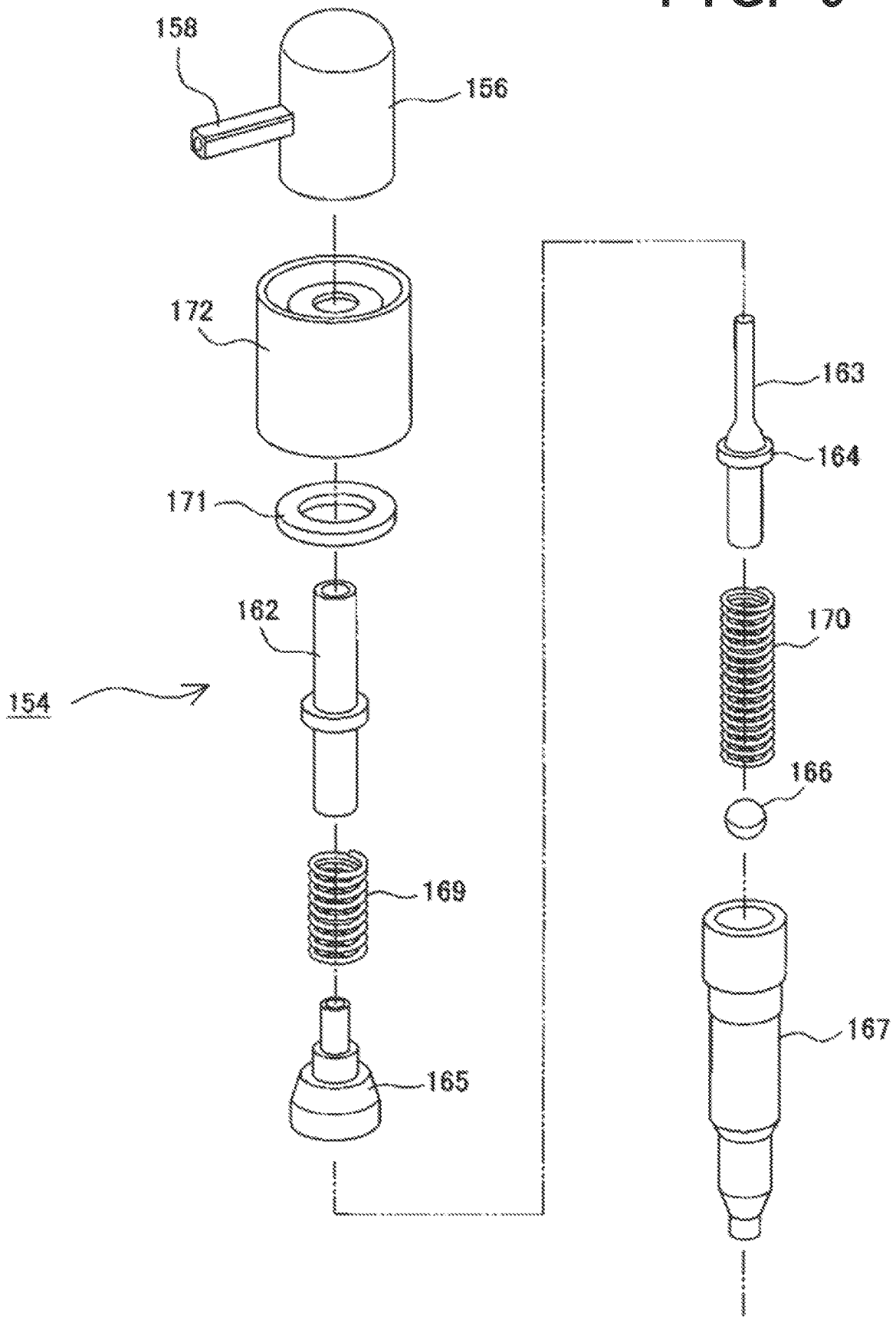
FIG. 9 is a view for explaining the arrangement of the liquid replenishing pump unit.

As shown in FIG. 8, the liquid replenishing pump unit 150 includes the liquid replenishing head portion 156 that is pressed by the press plate 102 to vertically move, the liquid replenishing piston portion 154 that temporarily holds the liquid and discharges the liquid to the liquid replenishing head portion 156, and the liquid replenishing tank portion 152 that stores the liquid to be replenished to the liquid replenishing piston portion 154. The liquid discharged from the liquid replenishing piston portion 154 when the liquid replenishing head portion 156 vertically moves is replenished, to the liquid reservoir 88, from a liquid replenishing joint portion 158 whose protruding port is extended from the liquid replenishing head portion 156 to the replenishment port 98 of the water addition pressurizing portion 80.

In the liquid replenishing tank portion 152, a moving plate 176 that moves along with the decrease of the liquid every time the liquid is discharged to the liquid replenishing joint portion 158 can be vertically moved by the liquid replenishing piston portion 154 to be described with reference to FIGS. 9 and 10. Furthermore, an air hole 178 that allows the movement of the moving plate 176 is formed in a liquid replenishing tank bottom portion 175 of the liquid replenishing tank portion 152.

The liquid replenishing piston portion 154 that discharges the liquid to the liquid replenishing head portion 156 will be described next with reference to FIG. 9. The liquid replenishing piston portion 154 is provided with a tank cap 172 that is threadably engaged with the liquid replenishing tank portion 152 and a liquid replenishing cylinder 167 that is fixed to the tank cap 172 to temporarily hold the liquid of the liquid replenishing tank portion 152. Note that a sealing 171 is provided between the tank cap 172 and a liquid replenishing tank 174 of the liquid replenishing tank portion 152. Note that the tank cap 172 is supported in the binding unit 60 by being fitted in a curved portion (FIGS. 4A, 4B, 6A, and 6B) below the replenishment port 98 of the pressurizing teeth support portion 84.

Furthermore, an upper piston 162 that similarly moves along with the vertical movement of the liquid replenishing head portion 156 is provided above the liquid replenishing cylinder 167. An upper spring 169 is wound around the upper piston 162, and a pump valve 165 around which the upper spring 169 is similarly wound is arranged below the upper piston 162. Inside the pump valve 165, a lower piston 163 around which a lower spring 170 is wound is located between the pump valve 165 and the lower portion of the liquid replenishing cylinder 167. A lower piston protruding portion 164 that pressure-bonds and seals the pump valve 165 is provided in the circumferential direction of the upper piston 162. Sealing of the lower piston protruding portion 164 is implemented by the lower spring 170.

At the lower end of the liquid replenishing cylinder 167, a ball valve 166 that takes in the liquid of the liquid replenishing tank 174 and seals the liquid replenishing cylinder 167 is provided. If the internal pressure in the liquid replenishing cylinder 167 increases, the ball valve 166 is located at the lower end of the liquid replenishing cylinder 167. If the internal pressure decreases, the ball valve 166 slightly moves upward to take in the liquid of the liquid replenishing tank 174.

Figure 10:
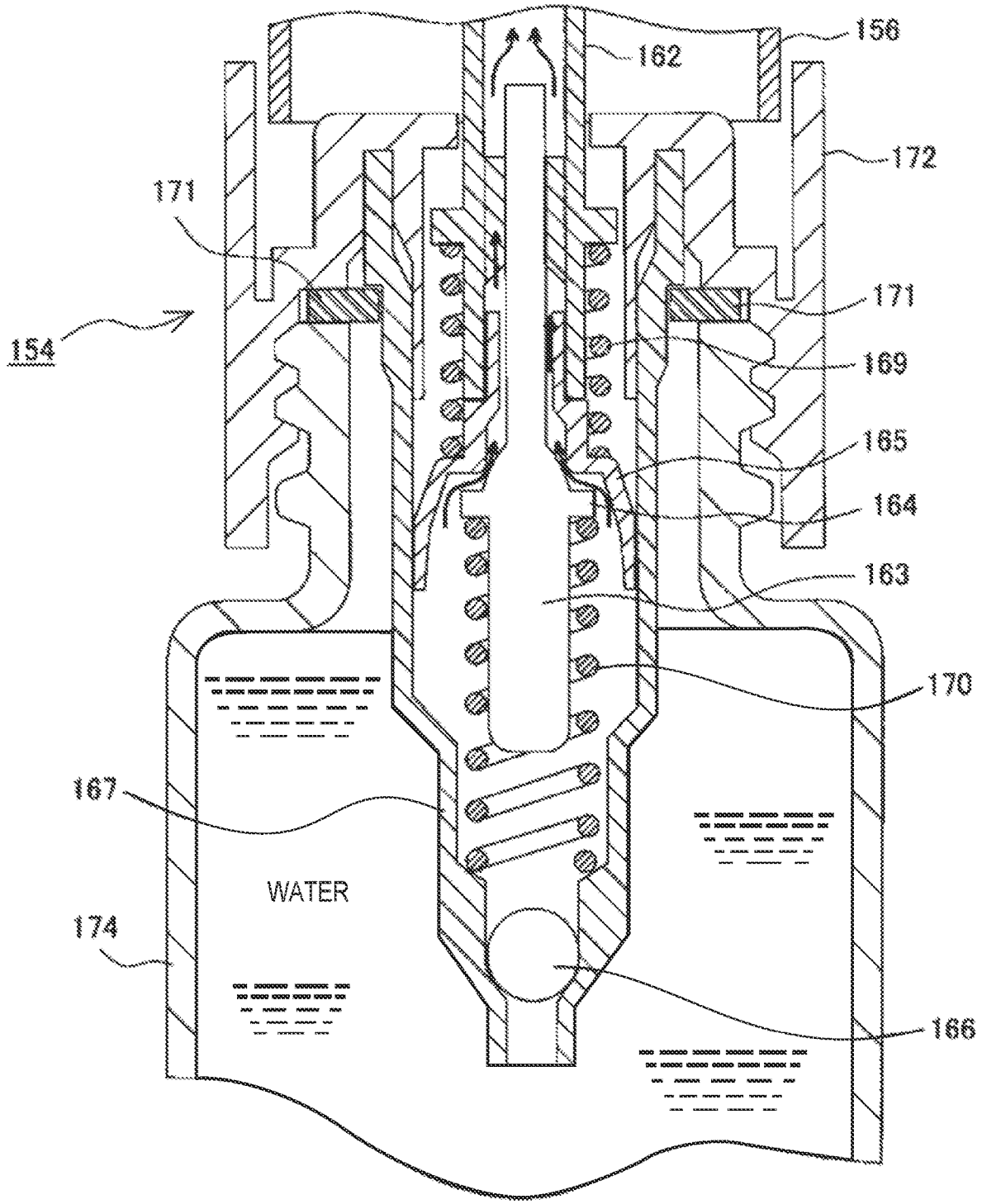
FIG. 10 is a view for explaining the arrangement of the liquid replenishing pump unit.

As shown in FIG. 10, if the above-described liquid replenishing pump unit 150 lowers when the liquid replenishing head portion 156 is pressed by the press plate 102, the upper piston 162 also lowers. This also presses the upper spring 169 winding around the upper piston 162, thereby pressing the pump valve 165. When the pump valve 165 lowers, the internal pressure of the liquid replenishing cylinder 167 increases since the ball valve 166 seals the lower end.

If the internal pressure of the liquid replenishing cylinder 167 exceeds a predetermined value, the liquid replenishing cylinder 167 and the upper spring 169 winding around the upper piston 162 are compressed by the internal pressure, thereby generating a gap between the pump valve 165 and the lower piston protruding portion 164. The liquid of the liquid replenishing cylinder 167 is discharged through the gap from the liquid replenishing joint portion 158 of the liquid replenishing head portion 156 to the liquid reservoir 88 via the pump valve 165, the upper portion of the lower piston 163, and the upper piston 162, as indicated by arrows in FIG. 10. If the liquid of the liquid replenishing tank 174 decreases, the moving plate 176 rises due to the decrease in pressure of the liquid replenishing tank 174, thereby making the liquid level in the liquid replenishing tank 174 constant all the time.

As described above, every time the press plate 102 is pressed, the liquid of the liquid replenishing tank 174 is replenished to the replenishment port 98 of the water addition pressurizing portion 80 via the liquid replenishing joint portion 158.

The pressure-bonding binding operation of the sheet bundle placed on the processing tray 58 in the binding unit 60 will be described below. When performing pressure bonding by a pair of groups of pressurizing teeth (the pressurizing teeth 82 and the receiving teeth 130), the binding unit 60 can selectively execute one of pressure bonding without applying any liquid (pressure-bonding binding without water addition) and pressure bonding after applying the liquid to a pressure-bonding portion (water-addition pressure-bonding binding). For example, the above processing may be executable in accordance with a selection operation by the user on a setting screen.

[Binding with Water Addition (Water-Addition Pressure-Bonding Binding)]

Figure 11A:
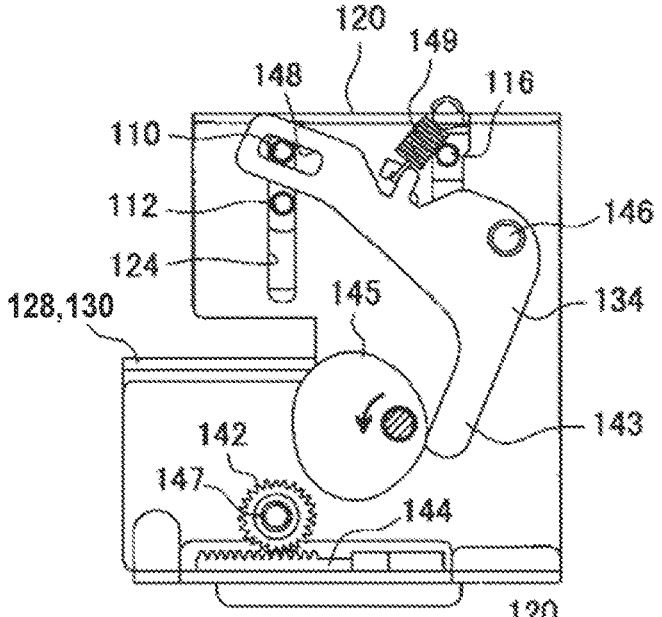
FIGS. 11A, 11B, and 11C are views for explaining an operation of performing pressure bonding by applying a liquid.
Figure 11B:
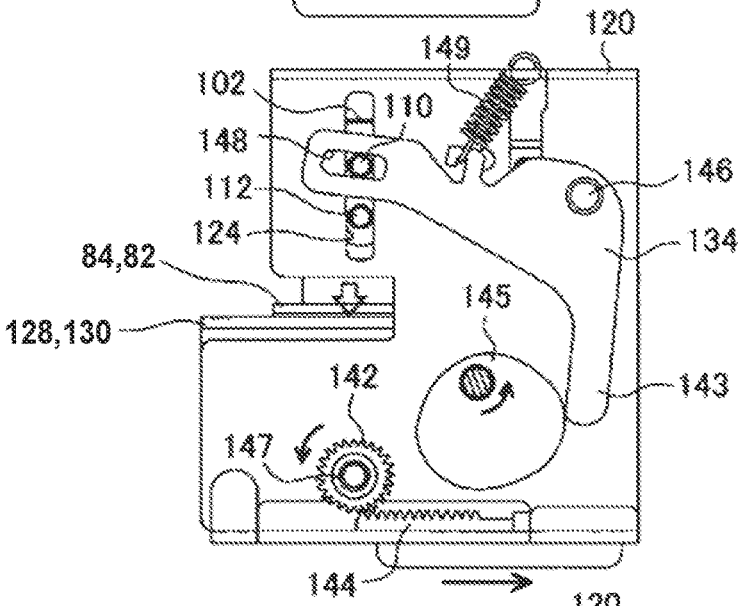
Figure 11C:
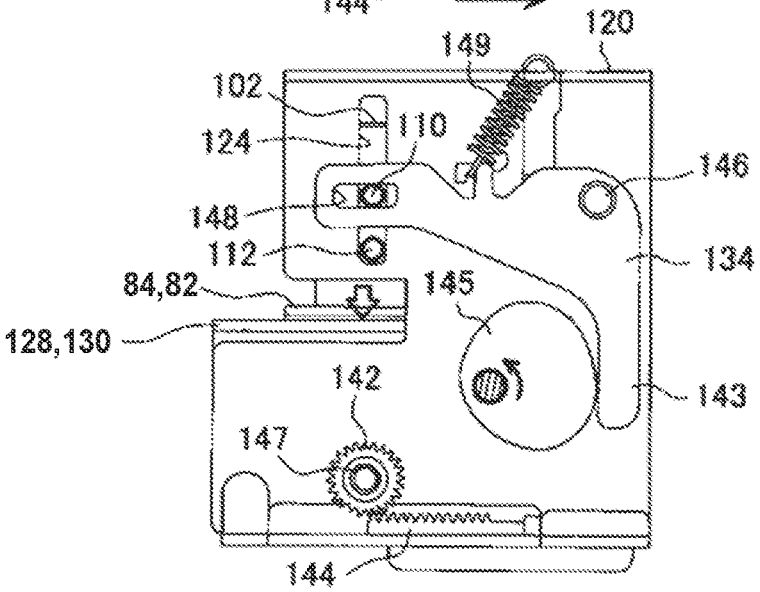
Figure 12A:
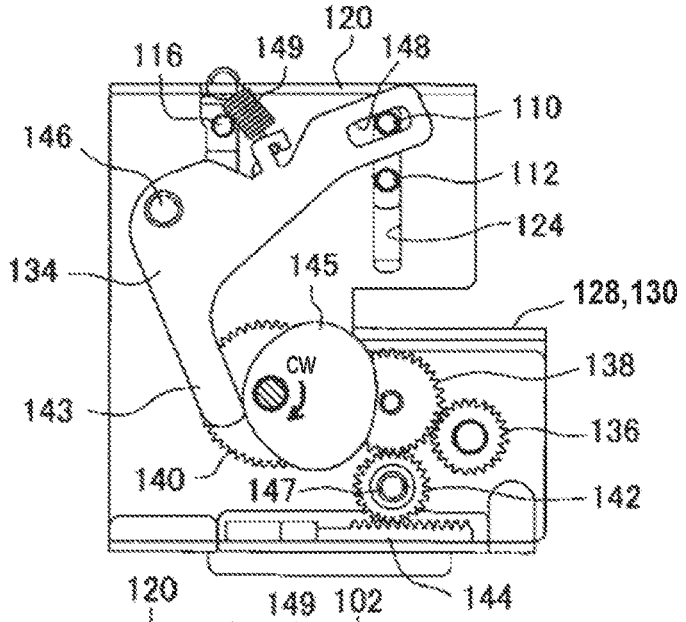
FIGS. 12A, 12B, and 12C are views for explaining the operation of performing pressure bonding by applying the liquid.
Figure 12B:
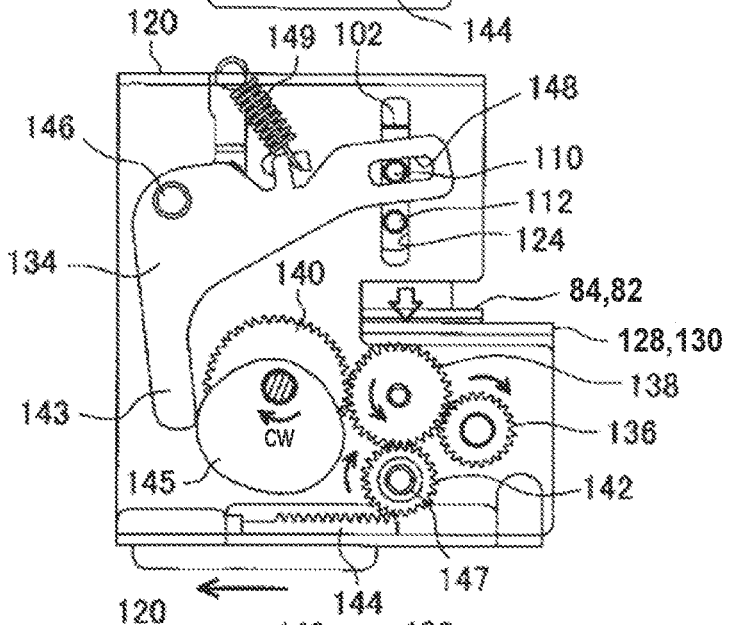
Figure 12C:
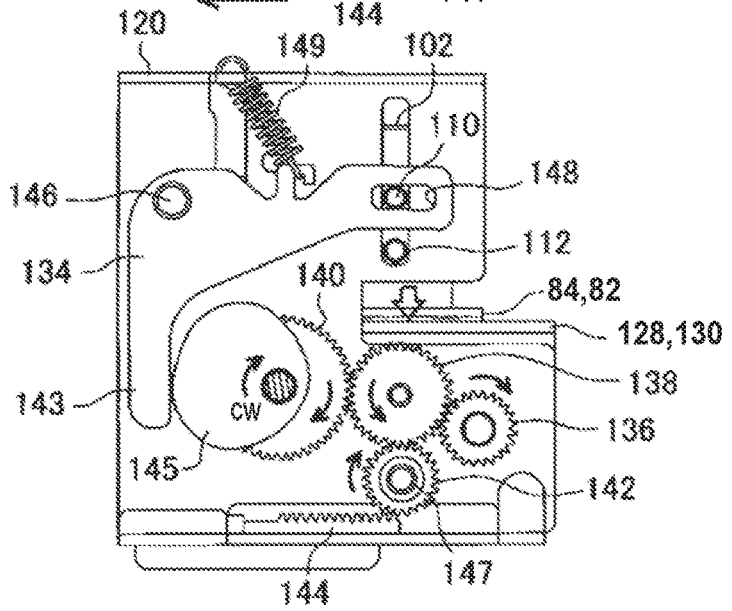
Figure 13A:
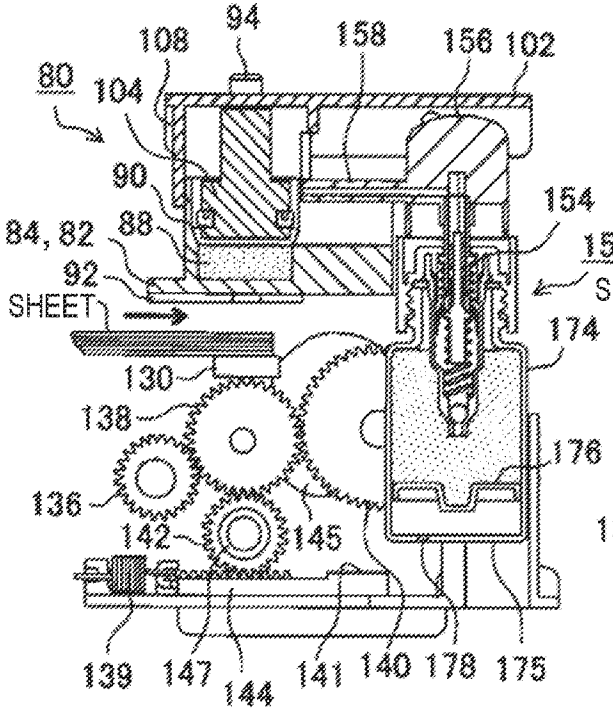
FIGS. 13A, 13B, and 13C are views for explaining the operation of performing pressure bonding by applying the liquid.
Figure 13B:
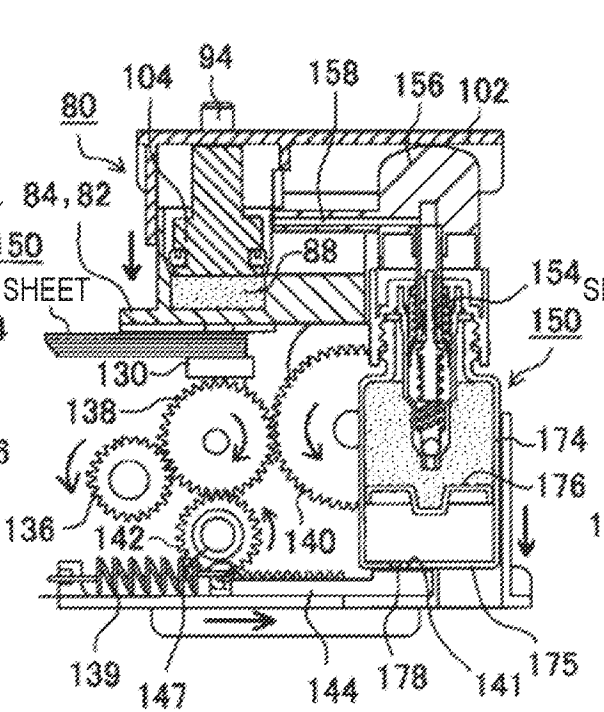
Figure 13C:
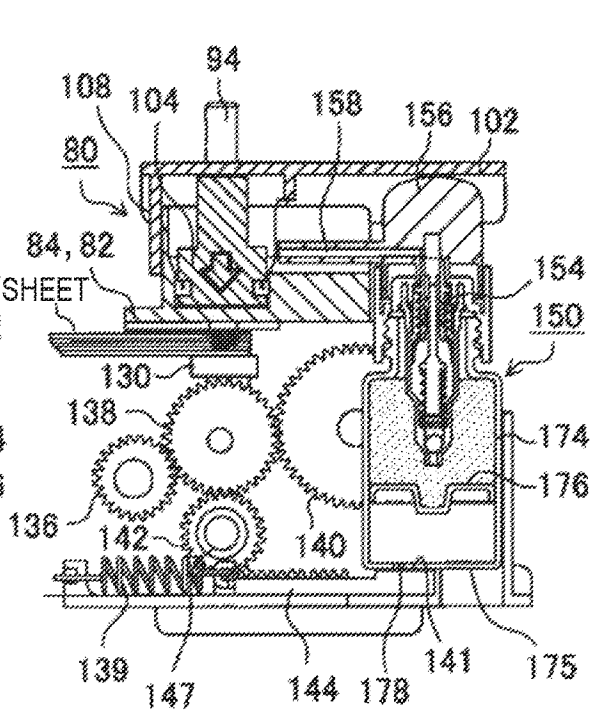

A water-addition pressure-bonding binding operation of performing binding by adding the liquid to a pressure-bonding range before pressure bonding by the pressurizing teeth 82 will be described with reference to FIGS. 11A to 13C. FIGS. 11A to 11C are views for explaining states when viewed from the front side of the binding unit 60. FIGS. 12A to 12C are views for explaining the states when viewed from the rear side. FIGS. 13A to 13C are sectional views for explaining water-addition pressure-bonding binding. FIGS. 11A, 12A, and 13A each show a state in which the pressurizing teeth support portion 84 (pressurizing teeth 82) is separated from the sheet. FIGS. 11B, 12B, and 13B each show a state when the pressurizing teeth support portion 84 (pressurizing teeth 82) is in press contact with the sheet. FIGS. 11C, 12C, and 13C each show a state in which pressure bonding is performed by applying the liquid to the sheet.

FIGS. 11A, 12A, and 13A each show the sheet acceptance initial time at which the sheets are placed on the processing tray 58, exist between the pressurizing teeth 82 and the receiving teeth 130 of the binding unit 60, and are placed on the receiving teeth support portion 128. In FIGS. 11A to 11C and 12A to 12C, the sheets are not illustrated, and FIGS. 13A to 13C show a state in which the sheets are stacked. When the designated number of sheets are placed on the receiving teeth support portion 128 including the receiving teeth 130, driving of the binding motor 60M starts. In this case, with respect to the rotation direction of the binding motor 60M, to add water, the binding motor 60M rotates in a direction opposite to the direction in which pressure bonding is performed without adding water as shown in FIGS. 14A to 14C, 15, and 16. The number of placed sheets is larger than five, and is, for example, eight in this embodiment.

That is, in this example, since binding with water addition is performed, the binding motor 60M is driven in a direction in which the moving cam 145 pivots in a counterclockwise direction on the front side and the moving cam 145 pivots in a clockwise direction on the rear side (a clockwise-direction driving motor in FIGS. 12A to 12C). Since each moving cam 145 has a symmetric shape centered on a rotation position, the protruding side of the moving cam 145 moves in a direction to press the distal end of the pivot arm 134. On the other hand, the action of the one-way clutch 147 causes the pinion gear 142 (pinion gear 142*b*) engaged with the intermediate gear 138 to start moving in a direction to support the liquid replenishing tank bottom portion 175 by a projecting portion 141 of the support rack 144.

In this example, by one-way rotation (in FIGS. 12A to 12C, rotation in the clockwise direction) of the binding motor 60M, the one-way clutch 147 intervening between the pinion gear 142 (pinion gear 142*b*) and the shaft meshes to move the support rack 144 to a position at which the liquid replenishing tank bottom portion 175 is supported. This movement fixes the liquid replenishing tank bottom portion 175. If the liquid replenishing head portion 156 is pressed by the press plate 102, the liquid replenishing piston portion 154 operates, thereby making it possible to supply water in the liquid replenishing tank 174 to the liquid reservoir 88 via the liquid replenishing joint portion 158. Note that as shown in FIGS. 13A to 13C, a rack return spring 139 that returns to the original position when the shaft reversely rotates to release engagement intervenes between the support rack 144 and the outer frame 120.

Subsequently, in FIGS. 11B, 12B, and 13B, the press plate 102 lowers to bring the pressurizing teeth support portion 84 including the pressurizing teeth 82 into tight contact with the outermost sheet of the sheet bundle. If, in this state, the press plate 102 is pressurized, the compression springs 96 intervening between the press plate 102 and the pressurizing teeth support portion 84 press the pressurizing teeth support portion 84 against the sheet. The pressurizing teeth support portion 84 is provided, on the side of the pressurizing teeth 82, with the elastic member (rubber plate) 92 surrounding the pressurizing teeth 82, and the elastic member 92 is brought into press contact with the sheet not to generate a gap between the pressurizing teeth 82 and the sheet surface. In this example, a setting is made so that a force of 70 kgf to 100 kgf acts on the sheet. Note that at this stage, the liquid reservoir 88 holds the liquid by the operation of the liquid replenishing piston portion 154. Since, however, the pressurizing piston 104 has not reached a pressurizing position with respect to the cylinder 90, water addition by pressurization is not performed.

In the state shown in FIGS. 11C, 12C, and 13C, the pivot arms 134 are moved by the moving cams 145 to lower the press plate 102 in a state in which the pressurizing teeth support portion 84 is in tight contact with the sheet. Then, the pressurizing piston 104 is inserted into the cylinder 90 to add the liquid of the liquid reservoir 88 to the sheet from the supply holes (supply tubes) 86 of the pressurizing teeth 82. Even after completion of water addition, the press plate 102 moves in a direction to pressure-bond the sheets by the moving cams 145, and thus the pressurizing piston 104 presses the pressurizing teeth 82 toward the receiving teeth 130 to pressure-bond the sheets. Pressure bonding at this time can be possible by a force of 300 kgf to 400 kgf which is weaker than the pressure-bonding force without water addition. In this example, a voltage to the binding motor 60M is controlled to set a force of 350 kgf, thereby generating a pressurizing force.

As already described, the liquid replenishing pump unit 150 replenishes the liquid from the liquid replenishing piston portion 154 to the liquid reservoir 88 by sandwiching the liquid replenishing head portion 156 and the liquid replenishing tank bottom portion 175 with the support rack 144, and pressing the liquid replenishing head portion 156. That is, as shown in FIGS. 13B and 13C, the support rack 144 is located in the liquid replenishing tank bottom portion 175, and the liquid replenishing pump unit 150 is fixed. This discharges the liquid from the liquid replenishing piston portion 154, thereby replenishing the liquid to the liquid reservoir 88. Note that water-addition pressure-bonding binding is performed for eight sheets on the processing tray 58.

[Pressurizing Teeth and Receiving Teeth of Water Addition Pressurizing Portion]

Figure 14A:
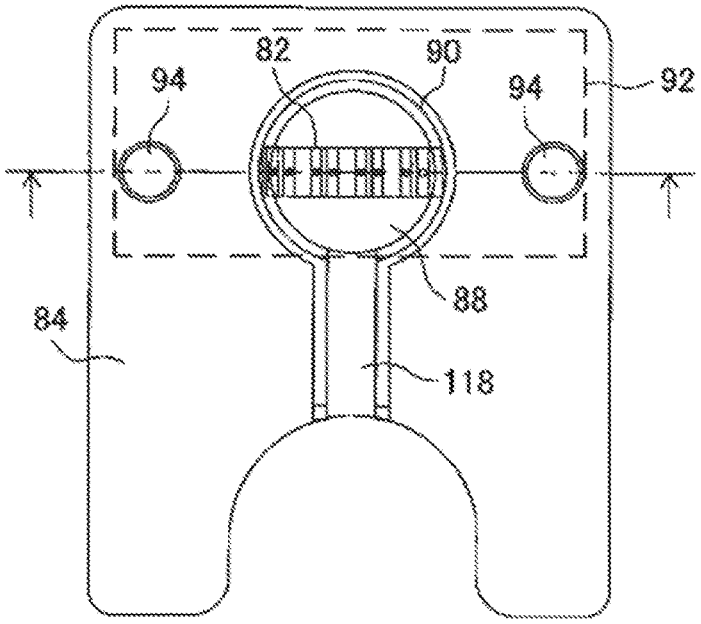
FIGS. 14A, 14B, and 14C are views for explaining the meshing state between pressurizing teeth and receiving teeth.

The pressurizing teeth 82 of the water addition pressurizing portion 80 and the receiving teeth 130 will be described with reference to FIGS. 14A to 14C. The meshing state and the positions of the supply holes (supply tubes) 86 will be described with reference to FIG. 15. FIG. 14A is a plan view for explaining the pressurizing teeth. As described above, the cylinder 90 that holds the liquid to be added to the sheet is provided on the rear side of the pressurizing teeth 82 which meshes the sheet. The cylinder 90 is formed in a columnar shape which is partially cut, and includes a range (the range of the liquid reservoir 88) where the pressurizing piston 104 pressurizes the liquid to add it, and a liquid replenishing port 118 that has a diameter larger than that of the range and receives an insertion guide of the pressurizing piston 104 and the liquid from the liquid replenishing pump unit 150.

Figure 14B:
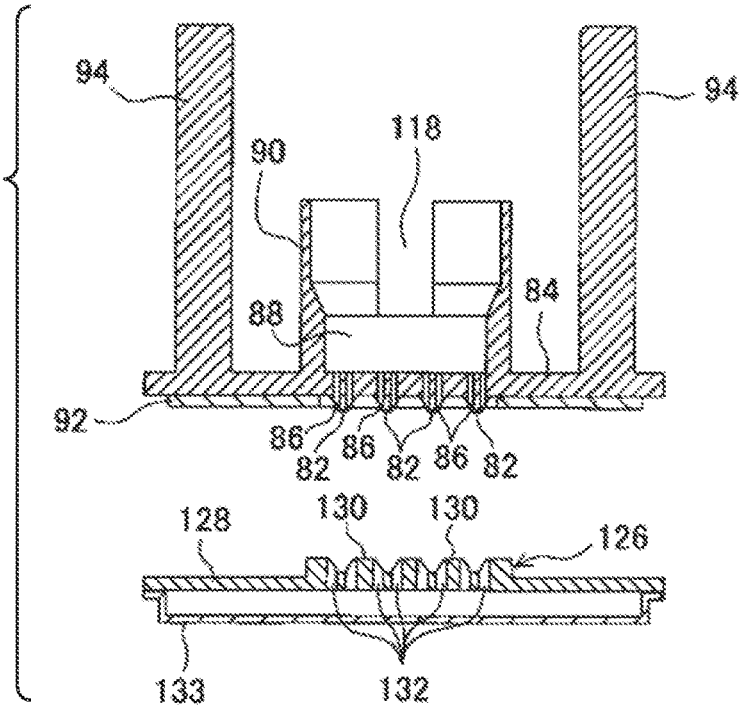

FIG. 14B is a sectional view for explaining the pressurizing teeth 82 and the receiving teeth portion 126 indicated by a two-dot dashed line in FIG. 14A. As is apparent from FIG. 14B, the pressurizing teeth support portion 84 is obtained by integrally forming the pressurizing teeth 82, the cylinder 90 on the rear side, and the guide bars 94. This secures the strength and ease of assembly. The receiving teeth 130 (receiving teeth portion 126) that mesh with the pressurizing teeth 82 and the drain tray 133, below the receiving teeth 130, that temporarily holds the remaining added liquid (residual liquid) are provided at a position opposite to the pressurizing teeth support portion 84.

Then, the supply holes (supply tubes) 86 for making it possible to add the liquid of the liquid reservoir 88 to the sheet are formed at a plurality of positions in the inclined portions of the pressurizing teeth 82. Furthermore, communicating holes 132 to the outside, through which air at the time of pressing the sheet by the pressurizing teeth support portion 84 and the residual liquid at the time of water addition pass, are formed in the inclined portions of the receiving teeth 130. Note that the communicating holes 132 are formed to have passage volumes larger than those of the supply holes (supply tubes) 86 so as to efficiently bleed air and draw the residual liquid.

Figure 14C:
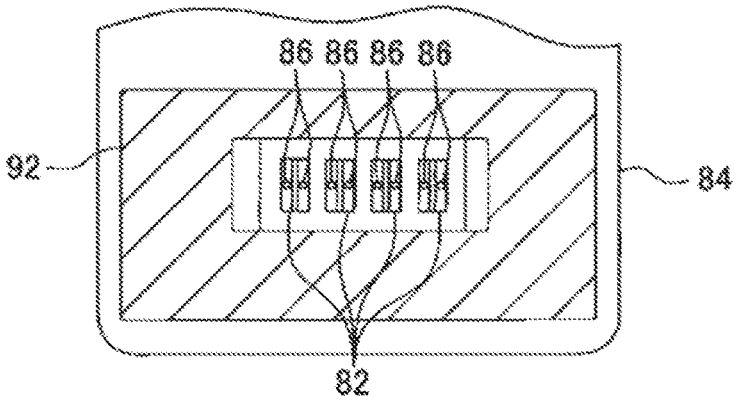

FIG. 14C is a view of the pressurizing teeth support portion 84 when viewed from the bottom surface on the side of the pressurizing teeth 82. The elastic member 92 that is made of a rubber material and surrounds the pressurizing teeth 82 is bonded to the pressurizing teeth support portion 84. This eliminates a gap around the pressurizing teeth 82 in a step of pressing the pressurizing teeth support portion 84 against the sheet by the compression springs 96, thereby reducing the applied liquid to spread outside the pressurizing region undergoing pressure bonding.

[Arrangement of Supply Holes (Supply Tubes) and Communicating Holes]

Figure 15:
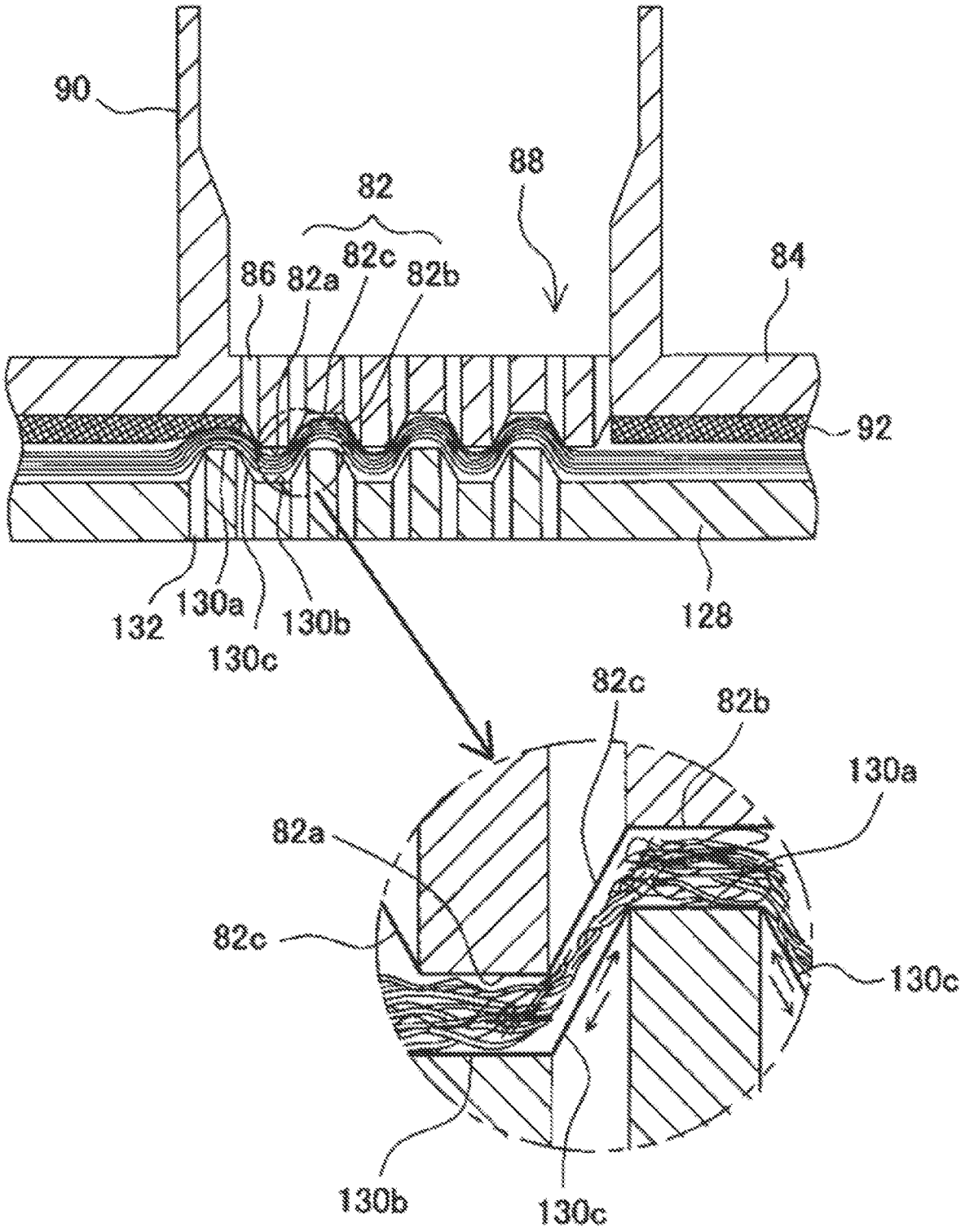
FIG. 15 is a view for explaining the meshing state between the pressurizing teeth and the receiving teeth.

The supply holes (supply tubes) 86 formed in the pressurizing teeth 82 and the communicating hole 132 to the outside (drain tray 133) formed in the receiving teeth 130, which are shown in FIGS. 14A to 14C, will be described with reference to FIG. 15. FIG. 15 is an enlarged view for explaining the pressurizing teeth 82 and the receiving teeth 130. The pressurizing teeth 82 include ridge portions 82*a* protruding to the receiving teeth 130, concave valley portions 82*b*, and inclined portions 82*c* forming them so as to form a three-dimensional structure in the sheet bundle by meshing with the receiving teeth 130 to tangle fibers. The receiving teeth 130 similarly includes receiving ridge portions 130*a*, receiving valley portions 130*b*, and receiving inclined portions 130*c*.

Then, the liquid from the liquid reservoir 88 in the cylinder 90 is pressed by the pressurizing piston 104 to be discharged from the supply holes (supply tubes) 86 formed in the pressurizing teeth 82. At this time, the supply holes 86 are arranged so that the liquid is discharged from a plurality of positions in the inclined portion 82*c*, as shown in FIG. 15. With this arrangement, if the pressurizing teeth 82 and the receiving teeth 130 mesh with each other to form a three-dimensional structure in the sheets, as indicated by a portion surrounded a two-dot dashed line in FIG. 15, it is confirmed that fibers (cellulose fibers in the case of paper) of the sheets are loosened in the inclined portions 82*c* and the receiving inclined portions 130*c* (opposite arrows in FIG. 15).

If the liquid is added to the positions of the inclined portions at which the fibers are loosened most, the liquid readily penetrates and the fibers are readily tangled by subsequent further pressurization. Thus, in this embodiment, the supply holes (supply tubes) 86 through which the liquid is added are arranged in the inclined portions 82*c* of the pressurizing teeth 82. In addition, the communicating holes 132 whose volumes are made larger than those of the supply holes (supply tubes) 86 so as to readily bleed air and draw the residual liquid are provided in the receiving inclined portions 130*c* of the receiving teeth 130.

[Pressurizing Teeth Support Portion and Receiving Teeth Support Portion]

Figure 16:
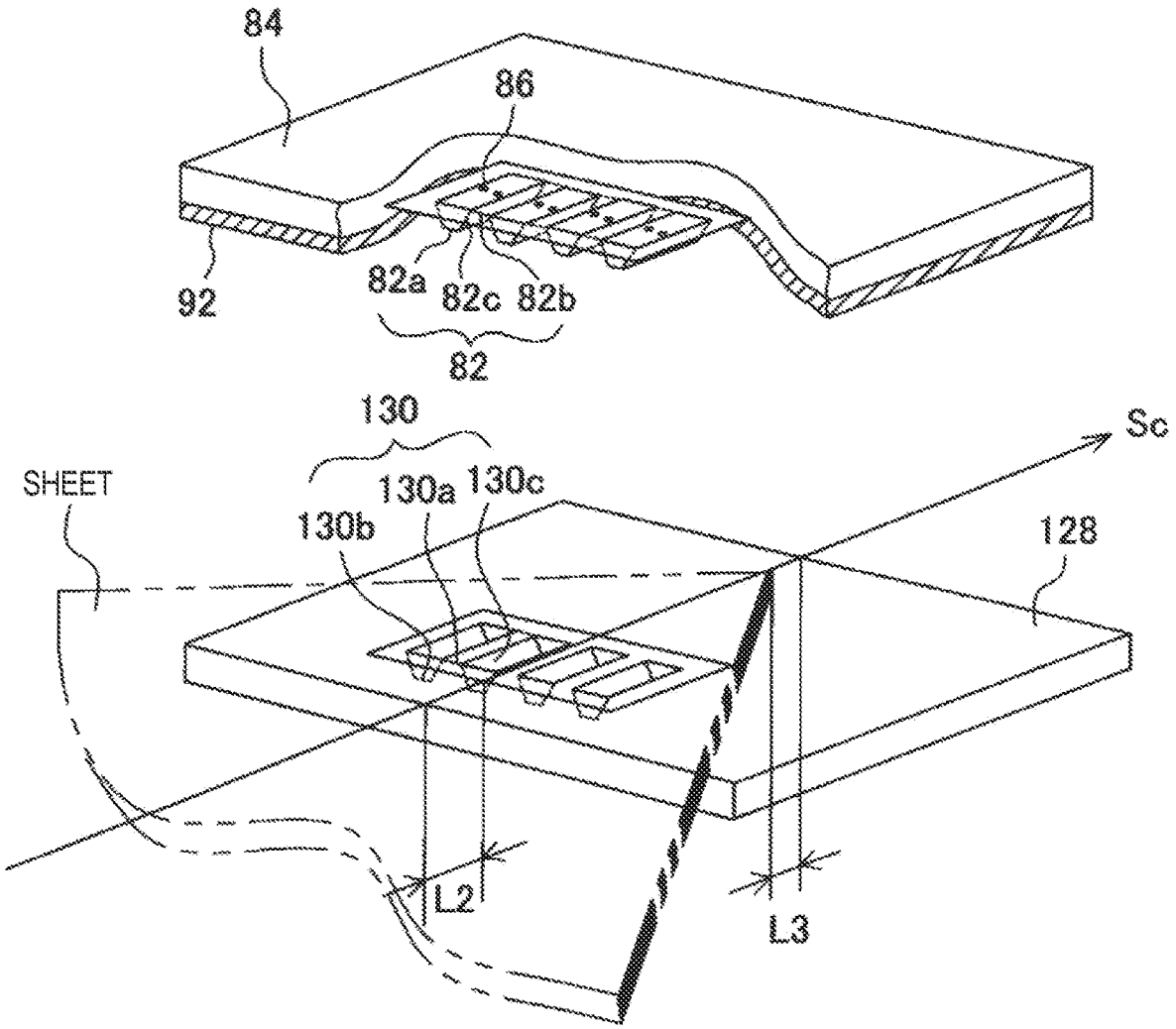
FIG. 16 is a view for explaining a sheet position.

The relationship between the positions of the pressurizing teeth support portion 84 and the receiving teeth support portion 128 and the position of the sheets clamped and pressed between the pressurizing teeth support portion 84 and the receiving teeth support portion 128 will be described next with reference to FIGS. 16 and 17A to 17C. FIG. 16 shows a sheet position when pressure-bonding binding is performed for a sheet corner portion on the front side of the processing tray 58 already described with reference to FIG. 1. When pressure-bonding the sheet corner portion, the sheets are located so that a pressurizing region where the pressurizing teeth 82 and the receiving teeth 130 meshing with the pressurizing teeth 82 pressurize the sheets is included in the sheets. In addition, the sheet position is restricted so that the pressurizing teeth support portion 84 supporting the pressurizing teeth 82 and the receiving teeth support portion 128 supporting the receiving teeth 130 are located outside the sheet corner portion by L3. Together with this, the pressurizing teeth support portion 84 and the receiving teeth support portion 128 abut against a position, at which no water is added (the added water does not penetrate), on a sheet gravity side by L2 with respect to a position at which the liquid added from the pressurizing teeth 82 penetrates.

Figure 17A:
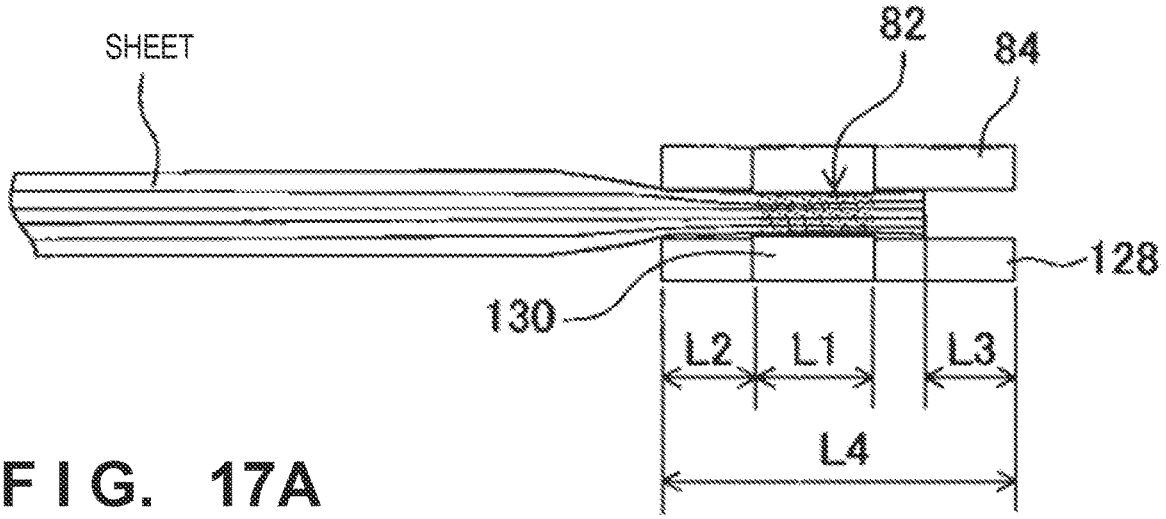
FIGS. 17A, 17B, and 17C are views for explaining the sheet position.
Figure 17B:
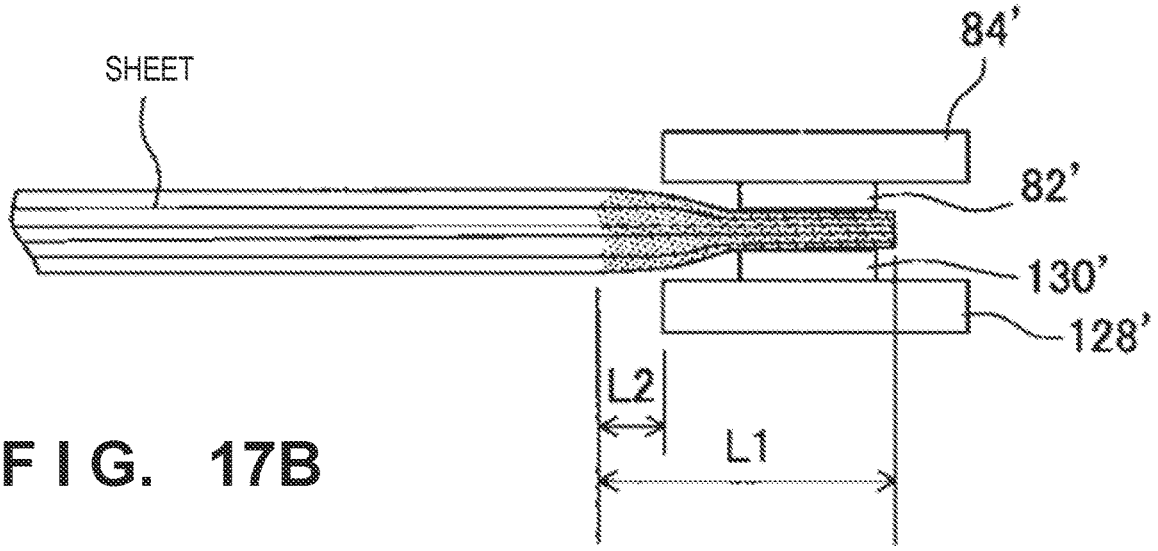
Figure 17C:
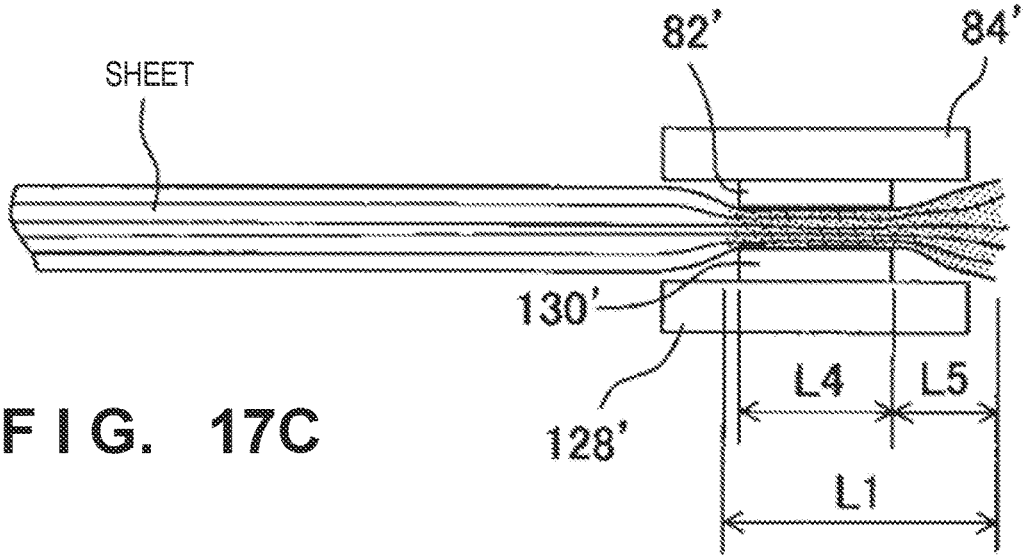

FIGS. 17A to 17C are views each showing the relationship between an application region where the liquid is applied to the sheet and the pressurizing region of the sheet by the pressurizing teeth 82 and the receiving teeth 130. It is possible to improve the pressure-bonding force of the sheet bundle by making the application region and the pressurizing region overlap each other, as compared with a case in which no liquid is applied.

FIG. 17A is a sectional view taken along a line Sc in FIG. 16. In FIG. 17A, the pressurizing teeth 82 and the receiving teeth 130 pressurize an application region L1.

Referring to FIG. 17B, the application region L1 intrudes on the sheet gravity side by exceeding the range of the pressurizing region. In this case as well, it is possible to improve the pressure-boding force of the sheet bundle. However, a state in which the fibers of the sheets are loosened by water addition is maintained. Therefore, at a position on the sheet gravity side, the sheets are readily torn. If the sheet applied with the liquid is left without being pressurized, the application region of the sheet is wrinkled, thereby worsening the appearance.

Referring to FIG. 17C, the application region L1 is larger than the pressurizing region, and protrudes to the sheet end portion side (a portion L5). In this case as well, it is possible to improve the pressure-bonding force of the sheet bundle. However, the sheet end portions which are not pressurized tend to fall apart. As shown in FIG. 17A, it is possible to improve the binding force of the sheet bundle without degrading the outer appearance of the sheet bundle by arranging the sheet bundle so that the application region becomes part of the pressurizing region.

Note that the above description indicates the front side of the processing tray 58 described with reference to FIG. 1. However, the same effect is obtained by processing the sheets on the rear side of the processing tray 58 in the same manner, as a matter of course.

The number of sheets to undergo pressure bonding and liquid application and a predetermined number of sheets as a reference for separating a case in which the pressure bonding is performed without applying the liquid, as described with reference to FIGS. 13A to 13C and 14A to 14C, and a case in which water-addition pressure-bonding binding of performing pressure bonding by applying the liquid is performed will be described with reference to FIG. 18A to 18D.

Figure 18A:
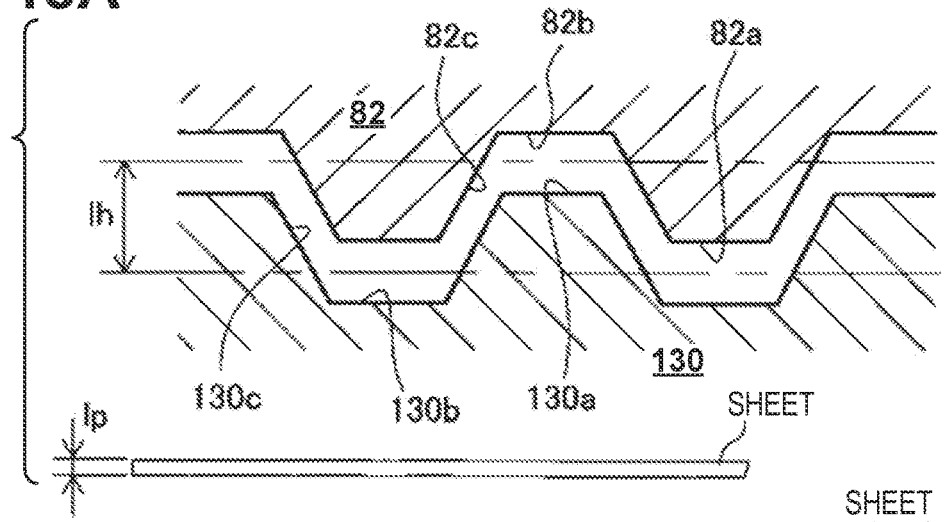
FIGS. 18A, 18B, 18C, and 18D are views for explaining the relationship between the number of sheets and application of the liquid.
Figure 18B:
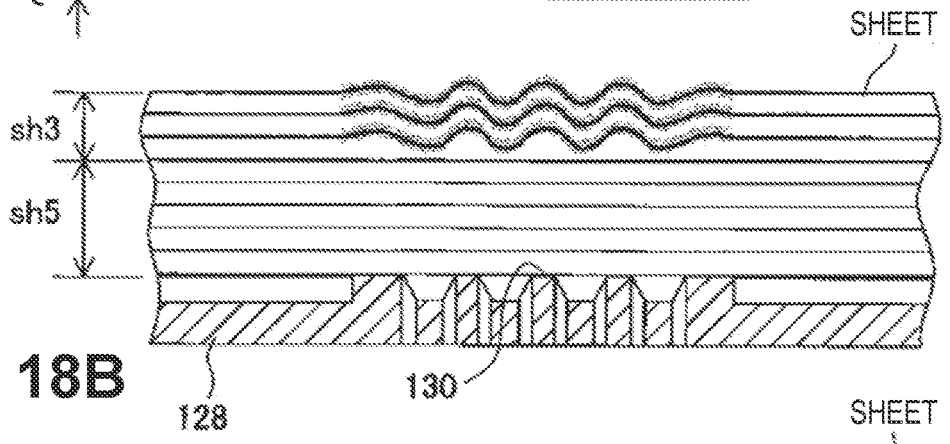
Figure 18C:
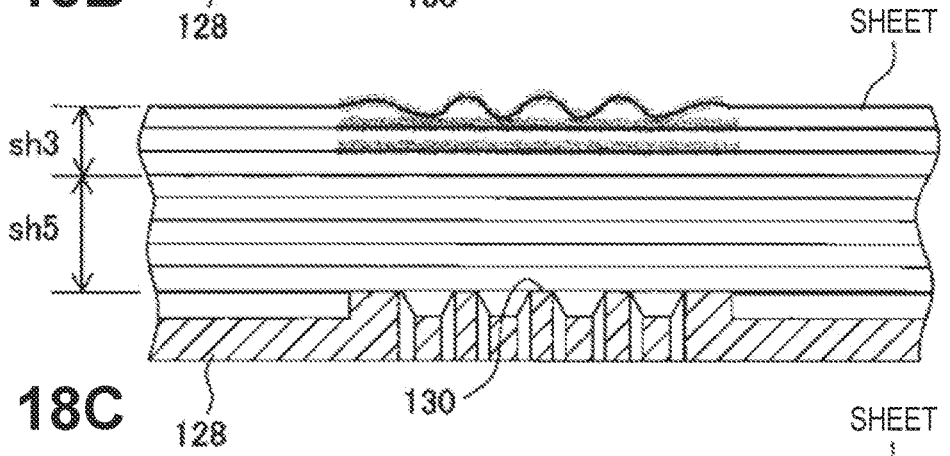
Figure 18D:
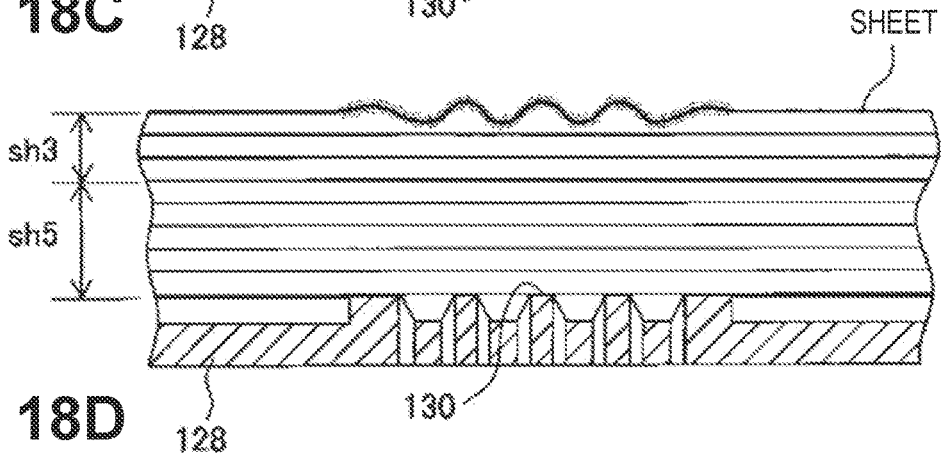

FIG. 18A is a view for explaining the relationship between the pressurizing teeth and the predetermined number of sheets, and schematically shows a case in which the upper teeth of a pair of groups of pressurizing teeth are the pressurizing teeth 82 and the lower teeth are the receiving teeth 130. As shown in FIG. 18A, the three-dimensional structure is formed in the sheets by a difference in height between the teeth meshing with each other, in other words, by a distance between the peak of the ridge portion 82*a* and the bottom of the valley portion 82*b*. The height is normally about 0.4 mm to 0.6 mm, and is set to 0.5 mm for meshing between the pressurizing teeth 82 and the receiving teeth 130.

On the other hand, a sheet used as a normal copy sheet is 68 g/m$^2$ paper and has a thickness lp of about 0.1 mm. Therefore, to form a three-dimensional structure without applying the liquid to the sheet, five sheets are appropriate. If the number of sheets exceeds five, the pressure-bonding force of the sheets bound without applying the liquid is weakened. Therefore, the predetermined number of sheets that undergo pressure-bonding binding without applying the liquid by the water-addition pressure-bonding binding unit 60 is set to five. When binding sheets, the number of which exceeds five, water-addition pressure-bonding binding is performed to pressure-bond sheets by applying the liquid to the sheet and temporarily loosening fibers of the sheets. As another form, if the difference in height between the teeth meshing with each other is 0.6 mm, the predetermined number of sheets is six, and if the difference in height is 0.4 mm, the predetermined number of sheets is four.

As described above, when binding sheets, the number of which is equal to or smaller than the predetermined number, pressure-bonding binding is performed without applying the liquid. When binding sheets, the number of which exceeds the predetermined number, water-addition pressure-bonding binding is performed by applying the liquid. As described above, water-addition pressure-bonding binding may be performed only if the pressure-bonding force decreases due to binding without applying the liquid.

[Explanation of Control Arrangement]

The control arrangement of an image forming system 1 will be described with reference to a block diagram shown in FIG. 19. The image forming system 1 shown in FIG. 19 includes an image forming apparatus and the sheet processing apparatus. The image forming apparatus includes an image forming control unit 200 that comprehensively controls the image forming apparatus. The sheet processing apparatus includes a sheet processing control unit 205 (including a control CPU) that comprehensively controls the sheet processing apparatus.

In the image forming apparatus, the image forming control unit 200 is communicably connected to a feeding control unit 202 and an input unit 203. A mode setting unit 201 sets an operation mode by selectively accepting, from a control panel 26 provided in the input unit 203, setting of (1) printout mode, (2) job sorting mode, (3) binding processing mode, (4) bookbinding (saddle stitch) processing mode, or (5) manual binding mode.

The sheet processing control unit 205 includes the control CPU, and operates the sheet processing apparatus in accordance with the operation mode (sheet processing mode) set by the mode setting unit 201. The sheet processing control unit 205 is communicably connected to a ROM 207 that stores an operation program and a RAM 206 that stores control data. The sheet processing control unit 205 acquires detection information from various sensor input units 220.

[Various Sensor Input Units]

The various sensor input units 220 include an entrance sensor 38 that detects conveyance of a sheet on which an image has been formed from the image forming apparatus, and manages various main motor driving operations by detecting the leading and trailing edges of a sheet. On the downstream side of the entrance sensor 38, a sheet sensor 39 that detects a sheet jam is located. In the processing tray 58, a processing tray empty sensor 58S that detects whether a sheet is placed is provided. Then, a stack tray position sensor 34S that detects a paper surface of a stack tray 34 for accumulating a sheet discharged by a discharge roller while gradually moving downward is provided. In addition to these sensors, a sensor that detects the position of a punch unit or the binding unit 60, a sensor that detects the operation of a saddle stitch unit, and the like may be provided.

[Output Units of Various Motors]

A conveyance control unit 210 that conveys a sheet is provided in the above-described sheet processing control unit 205. The conveyance control unit 210 controls a loading roller motor 41M for loading a sheet, a conveyance roller motor 48M for conveying the sheet to the processing tray 58, and a discharge roller motor 52M for discharging the sheet from the processing tray 58.

Furthermore, a punch control unit 211 is provided to perform punching processing for the trailing edge of the sheet loaded by a loading roller driven by the loading roller motor 41M. The punch control unit 211 controls a punch motor 40M that performs punching at a designated position in the width direction of the sheet. A processing tray control unit 212 controls an alignment plate motor 59M for moving the alignment plate 59 that aligns the sheet conveyed to the processing tray 58 by sandwiching the sheet from two sides in the sheet width direction.

A binding control unit 213 controls a binding motor 60M and a binding unit moving motor 60SM that moves the binding unit 60 to the designated position in the sheet width direction, thereby performing 2-point binding or corner binding, as shown in FIG. 1. The bound sheet bundle is discharged to the stack tray 34 by the discharge roller driven by a bundle moving belt and the discharge roller motor 52M. At this time, a tray vertical movement control unit 214 controls a stack tray motor 34M by detection of the stack tray position sensor 34S so that the position of the upper surface of the sheet is always fixed with respect to the discharge port.

Figure 19:
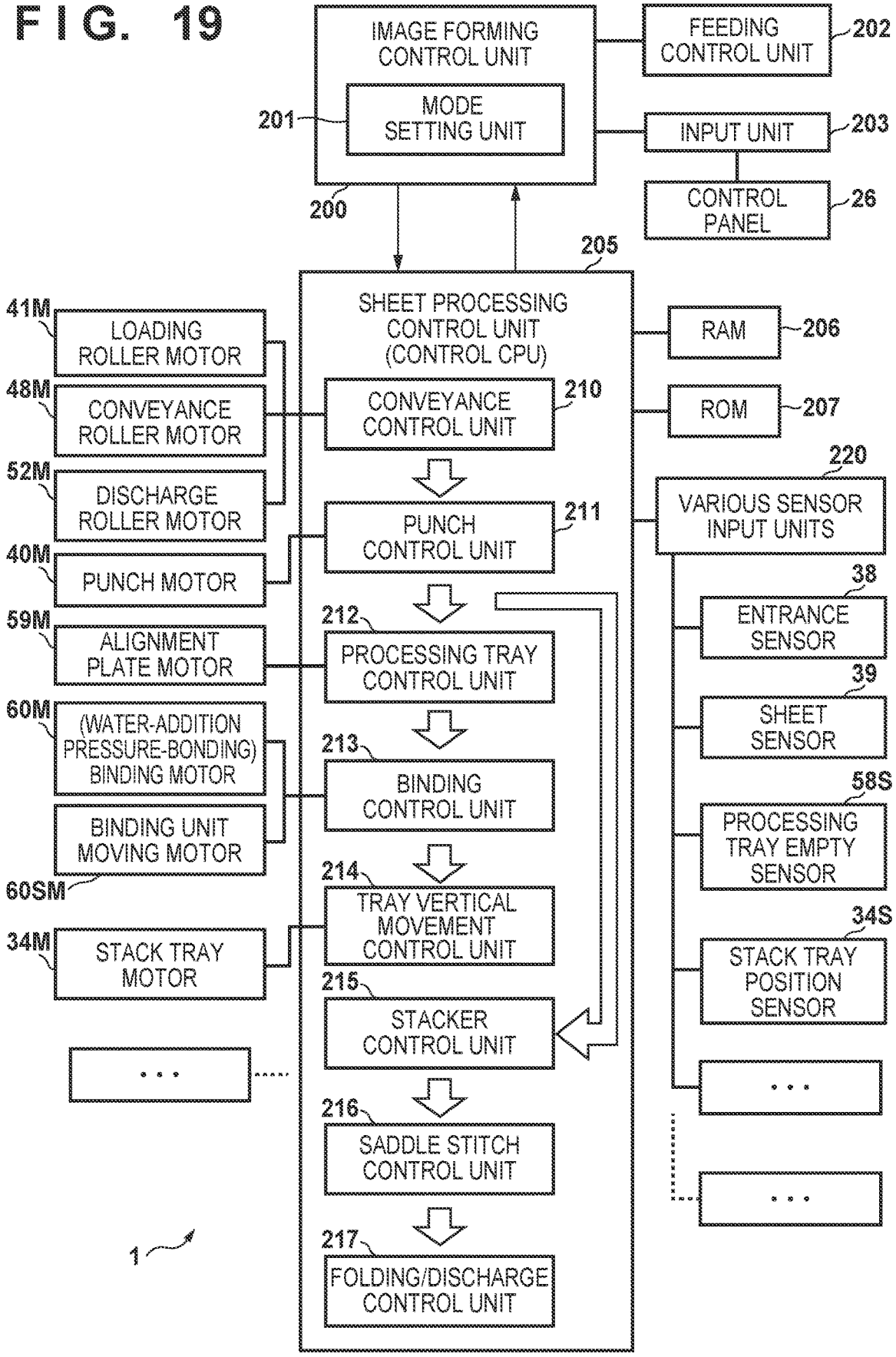
FIG. 19 is a block diagram showing the block arrangement of a control system.

The sheet processing control unit 205 may include a block except for the blocks shown in FIG. 19. For example, blocks corresponding to executable postprocessing such as a stacker control unit 215 for bookbinding (saddle stitch) processing, a saddle stitch control unit 216 for performing saddle stitch, and a folding/discharge control unit 217 may be provided.

Note that in each of the binding processing mode and the manual binding mode, a water-addition binding mode of performing binding by adding water to a binding position and a non-water-addition binding mode of performing binding without adding water can be executed. The sheet processing control unit 205 acquires bound sheet count information from the image forming control unit 200, and sets the water-addition binding mode or the non-water-addition binding mode in accordance with the number of sheets.

If a determination unit that determines whether the number of bound sheets is equal to or smaller than the predetermined number or exceeds the predetermined number may be implemented by the binding control unit 213, the sheet processing control unit (control CPU) 205, or the image forming control unit 200. Furthermore, the sheet bundle that clamped and pressurized by the pressurizing teeth 82 and the receiving teeth 130 may be measured by a known method and converted into the number of sheets, and the water-addition binding mode and the non-water-addition binding mode may be switched in accordance with the number of sheets of the sheet bundle.

The present invention is not limited to the above-described embodiment and various changes and modifications can be made without departing from the spirit and scope of the present invention. To apprise the public of the scope of the present invention, the following claims are made. Although the above embodiment indicates a preferable example, those skilled in the art can implement various alternate examples, corrected examples, modified examples, or improved examples from contents disclosed in this specification, and these examples are included in the technical scope described in the appended claims.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-073708 filed Apr. 8, 2019 and Japanese Patent Application No. 2020-058247 filed Mar. 27, 2020, which are hereby incorporated by reference herein in their entirety.

What is claimed is:

1. A sheet processing apparatus for performing binding processing for a sheet bundle formed from papers, comprising:

liquid including a surfactant, a static surface tension of the liquid including the surfactant being lower than a static surface tension of water, the static surface tension of the liquid including the surfactant being not higher than a critical surface tension of the paper to undergo the binding processing, the liquid including the surfactant being used to bind the sheet bundle;

a liquid tank configured to store the liquid including the surfactant;

an application unit configured to apply the liquid including the surfactant being stored in the liquid tank to a paper, wherein the application unit applies the liquid including the surfactant to an outermost paper of the sheet bundle; and a binding processing unit configured to bind the sheet bundle by pressurizing and clamping the papers together using the liquid including the surfactant, without using a staple, wherein the binding processing unit includes a pair of groups of pressurizing teeth, and the pressurizing teeth clamps and pressurize the sheet bundle, wherein in binding processing performed by the application unit and the binding processing unit, a liquid application region which is applied with the liquid including the surfactant and a pressurizing region which is pressurized by the pressurizing teeth are provided in the sheet bundle to overlap each other.

2. The apparatus according to claim 1, wherein each of the pressurizing teeth includes a supply hole, and the application unit supplies the liquid including the surfactant to the outermost paper from the supply holes.

3. The apparatus according to claim 1, further comprising a sheet count acquisition unit configured to acquire the number of papers of the sheet bundle, wherein, in a case where the number of papers of the sheet bundle is not larger than a predetermined number, the binding processing unit performs the binding processing without applying the liquid including the surfactant by the application unit.

4. The apparatus according to claim 1, wherein a region where the liquid including the surfactant is applied to the paper is part of a region against which the pressurizing teeth abut.

5. An image forming system comprising:

an image forming apparatus configured to form an image on a paper; and a sheet processing apparatus defined in claim 1 as a processing apparatus configured to process the paper discharged from the image forming apparatus.

6. A sheet processing apparatus for performing binding processing for a sheet bundle formed from papers, comprising:

liquid including a surfactant, a static surface tension of the liquid including the surfactant being lower than a static surface tension of water, a dynamic surface tension of the liquid including the surfactant being lower than a dynamic surface tension of water, the liquid including the surfactant being used to bind the sheet bundle;

a liquid tank configured to store the liquid including the surfactant;

an application unit configured to apply the liquid including the surfactant being stored in the liquid tank to a paper, wherein the application unit applies the liquid including the surfactant to an outermost paper of the sheet bundle; and a binding processing unit configured to bind the sheet bundle by pressurizing and clamping the papers together using the liquid including the surfactant, without using a staple, wherein the binding processing unit includes a pair of groups of pressurizing teeth, and the pressurizing teeth clamps and pressurize the sheet bundle, wherein in binding processing performed by the application unit and the binding processing unit, a liquid application region which is applied with the liquid including the surfactant and a pressurizing region which is pressurized by the pressurizing teeth are provided in the sheet bundle to overlap each other.

7. A sheet processing apparatus for performing binding processing for a sheet bundle formed from papers, comprising:

liquid including a surfactant, a value of a surface tension of the liquid including the surfactant in 50 msec after generation of gas-liquid interface being lower than 72.3 mN/m, the liquid including the surfactant being used to bind the sheet bundle;

a liquid tank configured to store the liquid including the surfactant;

an application unit configured to apply the liquid including the surfactant being stored in the liquid tank to a paper, wherein the application unit applies the liquid including the surfactant to an outermost paper of the sheet bundle; and a binding processing unit configured to bind the sheet bundle by pressurizing and clamping the papers together using the liquid including the surfactant, without using a staple, wherein the binding processing unit includes a pair of groups of pressurizing teeth, and the pressurizing teeth clamps and pressurize the sheet bundle, wherein in binding processing performed by the application unit and the binding processing unit, a liquid application region which is applied with the liquid including the surfactant and a pressurizing region which is pressurized by the pressurizing teeth are provided in the sheet bundle to overlap each other.

* * * * *